US007918531B2

(12) United States Patent
Sugiyama et al.

(10) Patent No.: US 7,918,531 B2
(45) Date of Patent: Apr. 5, 2011

(54) INK-JET RECORDING APPARATUS AND METHOD OF CLEANING RECORDING HEAD OF INK-JET RECORDING APPARATUS

(75) Inventors: Wataru Sugiyama, Aichi-ken (JP); Toru Mizuno, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 848 days.

(21) Appl. No.: 11/338,748

(22) Filed: Jan. 25, 2006

(65) Prior Publication Data

US 2006/0164448 A1 Jul. 27, 2006

(30) Foreign Application Priority Data

Jan. 25, 2005 (JP) ..... 2005-016987

(51) Int. Cl.
*B41J 2/165* (2006.01)

(52) U.S. Cl. ..... 347/23; 347/35

(58) Field of Classification Search ..... 347/5, 22, 347/23, 29, 30, 35
See application file for complete search history.

(56) References Cited

U.S. PATENT DOCUMENTS

| | | | | |
|---|---|---|---|---|
| 6,079,809 | A | 6/2000 | Yaegashi et al. | |
| 6,447,096 | B1 | 9/2002 | Yaegashi et al. | |
| 2002/0005873 | A1 | 1/2002 | Suzuki | |
| 2002/0171699 | A1 * | 11/2002 | Choi | 347/19 |
| 2003/0007031 | A1 | 1/2003 | Sugiyama | |
| 2004/0027409 | A1 * | 2/2004 | Miyauchi | 347/30 |
| 2004/0041862 | A1 | 3/2004 | Nakagawa et al. | |

(Continued)

FOREIGN PATENT DOCUMENTS

| | | |
|---|---|---|
| JP | 59 209877 | 11/1984 |

(Continued)

OTHER PUBLICATIONS

Japan Patent Office; Notification of Reason for Refusal in Japanese Patent Application No. 2005-016987 (counterpart to the above-captioned U.S. patent application) mailed Jan. 7, 2010.

(Continued)

*Primary Examiner* — Matthew Luu
*Assistant Examiner* — Jannelle M Lebron
(74) *Attorney, Agent, or Firm* — Baker Botts L.L.P.

(57) ABSTRACT

An ink-jet recording apparatus, including: a recording head including ink chambers each provided for each of inks of mutually different colors and nozzles each communicating with either of the ink chambers, the recording head performing recording by ejecting, from each of the nozzles, a corresponding one of the inks which corresponds to said each of the nozzles; an ink suction device including a cap arranged to fluid-tightly cover a nozzle surface of the recording head in which the nozzles are formed, the ink suction device sucking the inks from the nozzles utilizing the cap; and a control device for controlling the ink-jet recording apparatus, the control device including an initial-cleaning-operation executing portion which executes, upon initial working of the apparatus, an initial cleaning operation including: controlling the ink suction device to execute an initial ink sucking action wherein the inks are sucked from the nozzles; and controlling the recording head to execute (a) an all-nozzle-ink-ejecting action for all of the nozzles to eject the corresponding one of the inks from each of all of the nozzles at a plurality of shots and (b) a partial-nozzle-ink-ejecting action for at least one specific nozzle among the nozzles to eject the corresponding one of the inks from each of the at least one specific nozzle at a plurality of shots.

21 Claims, 13 Drawing Sheets

U.S. PATENT DOCUMENTS

2005/0007404 A1 1/2005 Usui

FOREIGN PATENT DOCUMENTS

| | | | |
|---|---|---|---|
| JP | H01-127362 | A | 5/1989 |
| JP | H07-195708 | A | 8/1995 |
| JP | H10-211720 | A | 8/1998 |
| JP | 2840416 | | 10/1998 |
| JP | 2000-108335 | A | 4/2000 |
| JP | 2002-273912 | A | 9/2002 |
| JP | 3363605 | | 10/2002 |
| JP | 2003-019816 | A | 1/2003 |
| JP | 2004-042285 | A | 2/2004 |
| JP | 2004-058446 | A | 2/2004 |
| JP | 2004-082579 | A | 3/2004 |
| JP | 2004-090458 | A | 3/2004 |
| JP | 2004-358965 | A | 12/2004 |

OTHER PUBLICATIONS

Japan Patent Office; Notification of Reason for Refusal in Japanese Patent Application No. 2005-016987 (counterpart to the above-captioned U.S. patent application) mailed May 11, 2010.

Japan Patent Office, Decision of Refusal in Japanese Patent Application No. 2005-016987, dated Feb. 1, 2011 (counterpart to the above-captioned U.S. patent application).

* cited by examiner

PRIOR ART

INK-JET RECORDING APPARATUS AND METHOD OF CLEANING RECORDING HEAD OF INK-JET RECORDING APPARATUS

The present application is based on Japanese Patent Application No. 2005-016987 filed on Jan. 25, 2005, the contents of which are incorporated herein by reference.

BACKGROUND OF THE INVENTION

1. Field of the Invention

The present invention relates in general to an ink-jet recording apparatus including a recording head which is moved in a predetermined direction for performing recording of images, characters and the like on a recording medium by ejecting inks having mutually different colors from corresponding nozzles. The present invention also relates to a method of cleaning the recording head of the ink-jet recording apparatus.

2. Discussion of Related Art

As an ink-jet recording apparatus which performs recording of images, characters and the like on a recording medium by ejecting inks based on input signals, there is conventionally known one which introduces the inks into the actuator of a recording head and ejects the inks pressurized by utilizing deflection or flexure of piezoelectric elements, electrostrictive elements and so on caused based on the input signals or utilizing local or partial boiling of the inks by heat-generating elements.

FIG. 13 schematically shows a recording head 90 of a conventional ink-jet recording apparatus. The recording head 90 has a plurality of nozzles 91 which are arranged in rows such that ink ejection openings thereof are open in the lower surface of the recording head 90. Each nozzle 91 is defined by side walls formed of a piezoelectric material, and ink droplets are ejected from each ink ejection opening owing to deformation of the side walls formed of the piezoelectric material. To each of the plurality of nozzles 91, there is supplied a corresponding one of inks such as a cyan ink, a yellow ink, a magenta ink, and a black ink from a corresponding one of manifolds 92 which correspond to the respective inks. Each of the manifolds 92 includes a manifold chamber 93 communicating with the corresponding nozzles 91 and an ink supply path 95 through which the corresponding one of the inks is supplied from a corresponding one of buffer tanks 94 to the manifold chamber 93. The ink supplied from a corresponding one of ink tanks not shown is stored in the buffer tank 94 and flowed from the buffer tank 94 to the corresponding nozzles 91 via the manifold 92.

In general, the ink-jet recording apparatus is subjected to a recording operation in factories prior to shipment thereof for the purpose of confirming or checking ink ejecting performance of the apparatus. In the recording operation, the ink tanks are actually installed on the apparatus for supplying the inks therefrom to the recording head 90 to perform the recording operation of recording test patterns, for instance. For shipment of the apparatus after the checking of the recording operation, the ink tanks are removed from tubes for supplying the inks from the ink tanks to the recording head 90, and the openings of the ink tanks and the tubes are respectively sealed by caps or the like. Further, there is attached a cap 96 to the recording head 90 for preventing contamination due to leakage of the inks and drying of the inks in the nozzles 91 during transportation, storage, etc., of the apparatus. The cap 96 is for removing air bubbles and foreign substances from the recording head 90. As shown in FIG. 13, the cap 96 is arranged to cover the ink ejection openings of all nozzles 91 and is connected to a suction pump not shown. With the ink ejection openings of the nozzles 91 covered with the cap 96, the inside of the cap 96 is subjected to a negative pressure, whereby the inks are sucked from the nozzles 91. This ink sucking action is generally called purging that is performed, after the recording head 90 has not been used for a long period of time, as a means for recovering the recording head 90 to a state in which the air bubbles and the foreign substances are not present in the same 90. In this connection, during transportation and storage of the ink-jet recording apparatus, the cap 96 covers the ink ejection openings of the nozzles 91 without performing the ink sucking action.

After shipment of the ink-jet recording apparatus in the state described above, the inks may leak out of the ink ejection openings of the nozzles 91 of the recording head 90 influenced by changes in the temperature and atmospheric pressure, vibration, etc., in the transportation or storage period of the apparatus before a user who has purchased the apparatus initially uses the apparatus. For instance, when the ink tanks are removed from the tubes and the caps are attached to respective ends of the tubes after checking of the ink ejecting performance as described above, the air tends to enter the tubes from the respective ends thereof and stay therein. In the meantime, because valves provided in ink passages from the ends of the tubes to the recording head 90 and a valve of the suction pump connected to the cap 96 are kept open, the inks may leak from the nozzles 91 of the recording head 90 and be drawn into the same 91 when the volume of the staying air varies due to changes in the temperature and atmospheric pressure. The inks which leak from the nozzles 91 gather or collect around the ink ejection openings of the nozzles 91 and mix with one another in the vicinity of the ink ejection openings of the adjacent nozzles 91, so that the mixed ink I enters insides of the nozzles 91 from the ink ejection openings thereof due to the change in the volume of the staying air, the surface tension, etc. Consequently, the insides of the nozzles 91, the manifolds 92, and the buffer tanks 94 may be contaminated with the mixed ink I.

In a case where the recording head 90 performs the recording operation with the nozzles 91 and so on contaminated with the mixed ink I, the mixed ink I is ejected from the nozzles 91 on a recording sheet, so that the recording operation is performed with the inks whose colors are different from original ones. To prevent this, JP-A-59-209877, for instance, discloses the following technique: The above-mentioned ink sucking action called purging by the cap 96 is performed for sucking the mixed ink I from the nozzles 91 and drawing new fresh inks from the ink tanks. Further, the mixed ink I is removed from the nozzles 91 and the manifolds 92 by so-called flushing, i.e., ejecting the inks from the nozzles 91 toward a waste-ink tray.

SUMMARY OF THE INVENTION

In the ink flow within the recording head 90, while the nozzles 91 and throttles not shown mainly cause resistance to the ink flow, the wall of each manifold 92 also causes the resistance to the ink flow. Described more specifically, in the manifold chamber 93 of each manifold 92, the resistance to the ink flow is small at its upstream portion connected to the ink supply path 95 and the resistance to the ink flow is large at its downstream portion remote from the ink supply path 95. Accordingly, in the above-mentioned ink sucking action, the ink flows fast at the upstream portion of the manifold chamber 93 and the ink flows slowly at the downstream portion of the same 93. Therefore, the new fresh ink is likely to be supplied to the upstream portion of the manifold chamber 93 so that the mixed ink is readily replaced with the new fresh ink whereas the mixed ink is not likely to be replaced with the new fresh ink at the downstream portion of the manifold chamber 93.

Further, where each manifold chamber 93 is constituted, as shown in FIG. 13, such that its wall surface confronting the corresponding nozzles 91 is inclined with a distance between the wall surface and the nozzles 91 gradually decreased toward the downstream portion of the manifold chamber 93 and such that its cross sectional area gradually decreases toward the downstream portion, the mixed ink I tends to stay on the inclined surface. As a result, the nozzles 91 located at the downstream portion of the manifold chamber 93 and opposed in close vicinity to the inclined surface tend to be influenced by the mixed ink I staying on the inclined surface.

The mixed ink I which is difficult to be removed by the sucking action is removed by flushing, i.e., ejecting the mixed ink I from the nozzles 91. For completely removing the mixed ink I, however, the ink is inevitably ejected from each of the nozzles 91 from which the mixed ink I can be removed by the sucking action. Namely, the ink is inevitably ejected from each nozzle 91 for which the removal of the mixed ink I by flushing need not be conducted. Accordingly, the total ink amount consumed by flushing undesirably becomes much larger than the minimum ink amount required for removing the mixed ink I.

Incidentally, when the ink-jet recording apparatus described above is transported by shipping or the like for exporting abroad, for instance, a plurality of the ink-jet apparatus each packed in a cardboard box together with cushioning materials are stacked on a palette. When considering a load to be applied to the apparatus located at the bottom part of the stack on the palette, there is inevitably an upper limit in the number of the apparatus that can be stacked on the palette. To enhance the carrying or loading efficiency in the transportation, if the ink-jet recording apparatus of wide and slim type is packed with its front or rear facing downward, it is possible to reduce the floor space when the packed apparatus are stacked on the palette. Thus, the loading efficiency can be enhanced.

In a case where the ink-jet apparatus is packed as mentioned above, the recording head 90 wherein the ink ejection openings of the nozzles 91 are formed in its nozzle surface which is to face downward in the recording operation for ejecting the ink droplets downwardly in the recording operation assumes, upon packing, a posture in which the ink ejection openings of the nozzles 91 face sideways and the rows of the nozzles extend in the vertical direction. With the recording head 90 kept in the posture, the inks which leak from the nozzles 91 drop therefrom and mix with each other in the cap 96. In this case, too, the thus mixed ink I enters the insides of the nozzles 91 from the ink ejection openings thereof. Further, because the nozzles 91 face sideways, namely, extend horizontally, the mixed ink I which have flowed into the nozzles 91 tend to diffuse into the buffer tanks 94, thereby contaminating the buffer tanks 94. As the contamination by the mixed ink I spreads in the recording head 90, the ink amount to be consumed by purging and flushing for removing the mixed ink I undesirably increases.

It is therefore an object of the present invention to provide an ink-jet recording apparatus and a method of cleaning a recording head of an ink-jet recording apparatus, which apparatus and method are capable of completely removing, with a reduced ink consumption amount upon initial working of the apparatus, a mixed ink entered nozzles, ink chambers and buffer tanks during transportation, storage, and so on before the initial working.

The inventor of the present invention has made an extensive study on diffusion region of the mixed ink within the recording head, the resistance to the ink flow in the recording head, the transportation and storage conditions, and so on. As a result of the study, the inventor has developed a technique of reliably removing, with a reduced ink consumption amount upon initial working of the ink-jet recording apparatus, the mixed ink entered the recording head during transportation, storage, and so on, thereby preventing contamination due to the mixed ink.

To achieve the above-indicated object of the present invention, the invention provides an ink-jet recording apparatus, comprising: a recording head including a plurality of ink chambers each provided for each of plurality of inks of mutually different colors and a plurality of nozzles each of which communicates with either of the ink chambers, the recording head performing recording by ejecting, from each of the nozzles, a corresponding one of the inks which corresponds to said each of the nozzles; an ink suction device including a cap arranged to fluid-tightly cover a nozzle surface of the recording head in which the nozzles are formed, the ink suction device sucking the inks from the nozzles utilizing the cap; and a control device for controlling the ink-jet recording apparatus, the control device including an initial-cleaning-operation executing portion which executes, upon initial working of the ink-jet recording apparatus, an initial cleaning operation including: controlling the ink suction device to execute an initial ink sucking action wherein the inks are sucked from the nozzles; and controlling the recording head to execute (a) an all-nozzle-ink-ejecting action for all of the nozzles to eject the corresponding one of the inks from each of all of the nozzles at a plurality of shots and (b) a partial-nozzle-ink-ejecting action for at least one specific nozzle among the plurality of nozzles to eject the corresponding one of the inks from each of the at least one specific nozzle at a plurality of shots.

Here, "initial working" of the ink-jet recording apparatus means that the ink-jet recording apparatus is initially used by a user after its manufacture or a quality inspection conducted thereon. Upon the initial working of the apparatus, the initial-cleaning-operation executing portion of the control device controls the ink sucking device to execute the initial ink sucking action in which the inks in the respective ink chambers are sucked from the corresponding nozzles of the recording head, whereby the mixed ink entered the nozzles and the ink chambers during transportation, storage, etc., of the apparatus before the initial working can be removed by sucking. Further, the initial-cleaning-operation executing portion controls the recording head to execute, as an initial ink ejecting action, the all-nozzle-ink-ejecting action and the partial-nozzle-ink-ejecting action. Described in detail, by execution of the all-nozzle-ink-ejecting action for all of the nozzles to eject corresponding one of the inks from each of all of the nozzles at a plurality of shots, the mixed ink remaining in the nozzles, etc., after the initial ink sucking action is ejected. Further, by execution of the partial-ink-ejecting action for the at least one specific nozzle to eject the corresponding one of the inks from each of the at least one specific nozzle at a plurality of shots, the mixed ink remaining in each of the at least one specific nozzle can be removed therefrom while reducing the entire ink consumption amount because the other inks corresponding to the nozzles other than the at least one specific nozzle are not ejected in the partial-nozzle-ink-ejecting action.

To achieve the above-indicated object of the present invention, the invention also provides a method of cleaning a recording head of an ink-jet recording apparatus upon initial working thereof, the recording head including: a plurality of ink chambers each provided for each of plurality of inks of mutually different colors; and a plurality of nozzles each of which communicates with either of the ink chambers, the recording head performing recording by ejecting, from each of the nozzles, a corresponding one of the inks which corresponds to said each of the nozzles, the method comprising: sucking the inks from the nozzles; ejecting the corresponding one of the inks from each of all of the nozzles at a plurality of shots; and ejecting the corresponding one of the inks from each of at least one specific nozzle among the plurality of nozzles at a plurality of shots.

The present method described above enjoys effects similar to those described with respect to the above-indicated ink-jet recording apparatus.

BRIEF DESCRIPTION OF THE DRAWINGS

The above and other objects, features, advantages and technical and industrial significance of the present invention will be better understood by reading a following detailed description of preferred embodiments of the invention, when considered in connection with the accompanying drawings, in which.

DETAILED DESCRIPTION OF THE INVENTION

First Embodiment

Figure 1:
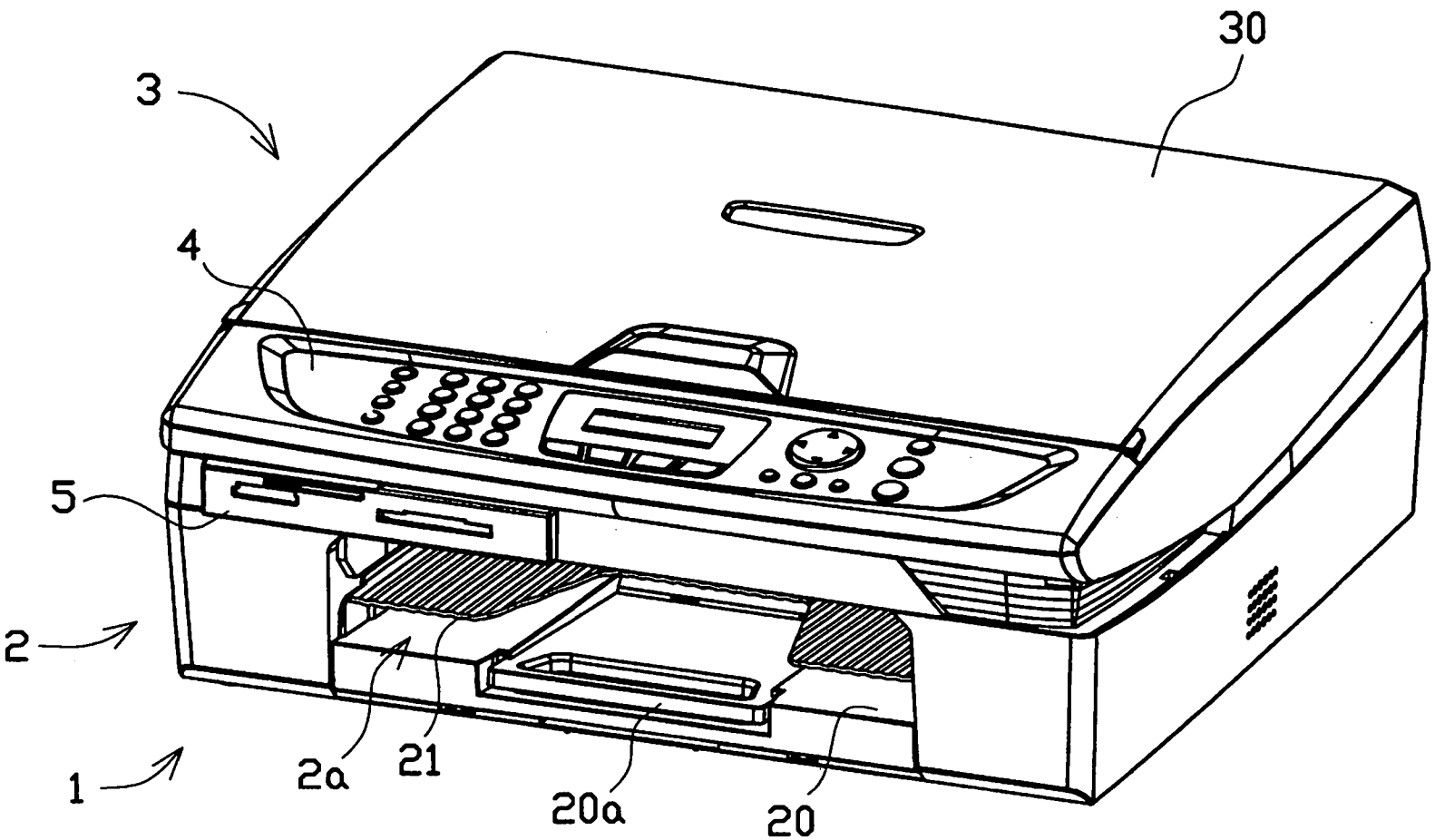
FIG. 1 is a perspective view showing a composite machine according to a first embodiment of the present invention.

Referring to the drawings, there will be explained a composite machine 1 (an ink-jet recording apparatus) according to a first embodiment of the present invention. As shown in FIG. 1, the present composite machine 1 is a multi function device (MFD) integrally including a printing portion 2 at its lower part and a scanning portion 3 at its upper part and having a printing function, a scanning function and a copying function. In the composite machine 1, the printing portion 2 functions as a main part of the ink-jet recording apparatus of the invention, and the functions other than the printing function are arbitrary. Accordingly, the principle of the invention may be applied to a printer simply having the printing function without having the scanning function and the copying function. The composite machine 1 may be equipped with a communicating portion to additionally have a facsimile function or the like.

Where the ink-jet recording apparatus of the invention is used in the form of a composite machine, the composite machine, may be a small-size machine shown in FIG. 1 or a large-size machine equipped with a plurality of sheet-supply cassettes and an auto document feeder (ADF). The composite machine 1 is arranged to be connected to a computer not shown and perform recording of images, characters and the like on recording sheets based on image data and character data transmitted from the computer. The composite machine 1 may be arranged to be connected to a digital camera and perform recording of image data outputted from the digital camera. Further, a memory device of various types may be installed on the composite machine 1 for recording, on recording sheets, image data recorded in the recording medium.

As shown in FIG. 1, the composite machine 1 is wide and slim type with its width and depth being made larger than its height and has a generally rectangular parallelepiped configuration. The printing portion 2 is positioned at the lower part of the composite machine 1. The printing portion 2 has a front opening 2*a*. A sheet-supply tray 20 and a sheet-discharge tray 21 are superposed on each other in a vertical direction so as to be exposed to the front opening 2*a*. The sheet-supply tray 20 is for accommodating recording media in the form of recording sheets in various sizes of a A4 size or smaller, such as a B5 size, a postcard size, or the like. The sheet-supply tray 20 has a slide tray portion 20*a* that is arranged to be slidable and pulled out when necessary, so as to enlarge a sheet-receiving area. The recording sheets (not shown) accommodated in the sheet-supply tray 20 are fed toward an inside of the printing portion 2 where a desired image or the like is recorded, and discharged to the sheet-discharge tray 21.

Figure 2:
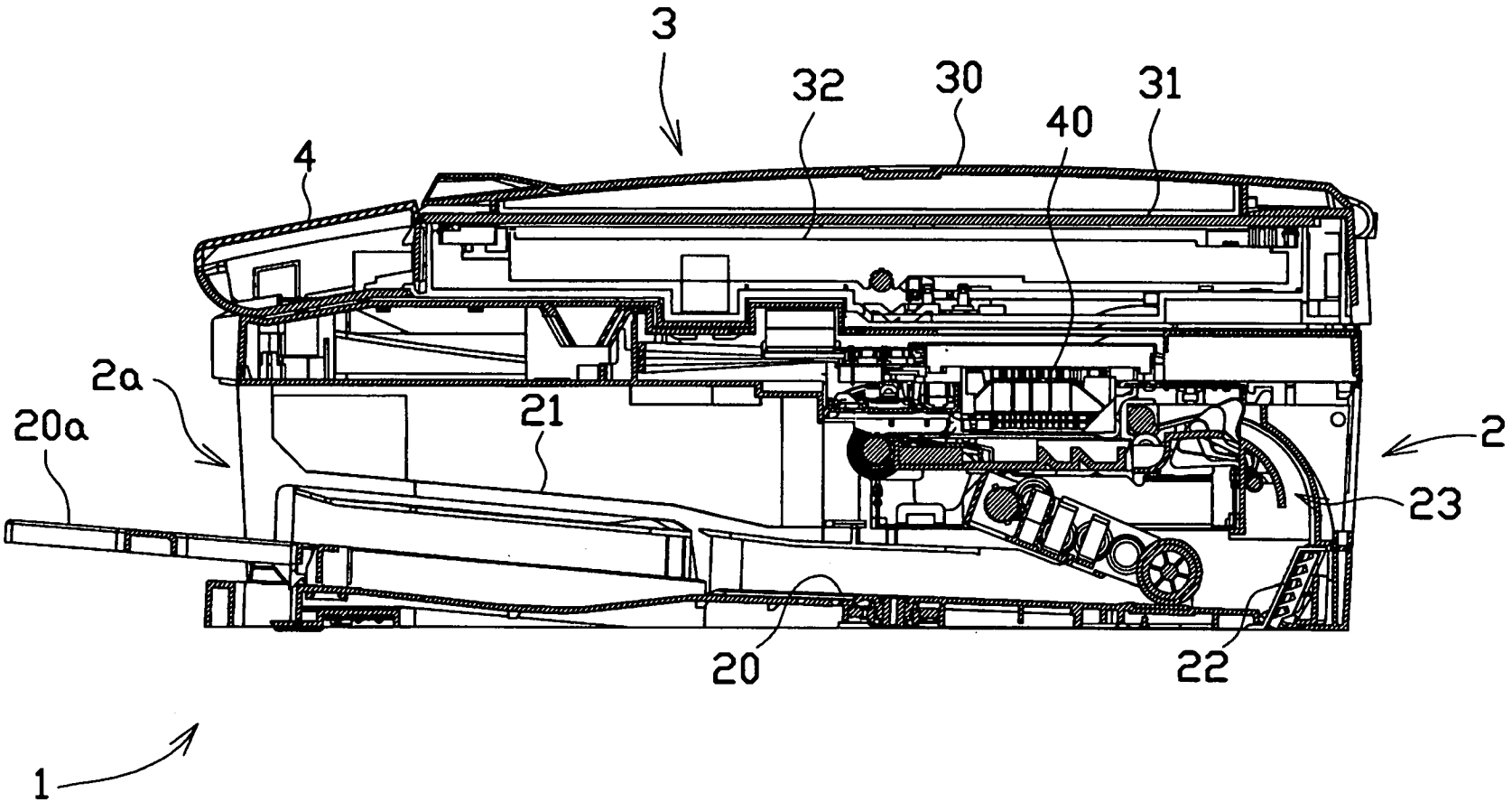
FIG. 2 is a side elevational view in cross section showing an internal structure of the composite machine of FIG. 1.

The scanning portion 3 positioned at the upper part of the composite machine 1 is constituted as a so-called flat-bed scanner. As shown in FIGS. 1 and 2, a platen glass 31 and an image-reading carriage 32 are provided below an original or manuscript cover 30 provided as a top plate of the composite machine 1 so as to be openable and closable. On the platen glass 31, an original or a manuscript is to be placed for image reading. The image-reading carriage 32 which can be moved in the width direction of the composite machine 1 is provided below the platen glass 31 such that a main scanning direction of the image-reading carriage 32 coincides with the depth direction of the composite machine 1.

On a front side of the upper part of the composite machine 1, there is provided an operation panel 4 for controlling operations of the printing portion 2 and the scanning portion 3. The operation panel 4 is constituted by including various control buttons and keys, a liquid crystal display, etc. The composite machine 1 is arranged to be operated in accordance with commands inputted through the operation panel 4 and commands transmitted, via a printer driver, from the computer connected thereto. For instance, at an upper left portion on the front side of the composite machine 1, there is provided a slot 5 into which is insertable a small-size memory card of various types as the memory device. The image data recorded in the small-size memory card which is inserted in the slot 5 is read out therefrom so as to be displayed on the crystal liquid display portion, and there is made an input, through the operation panel 4, that permits the printing portion 2 to record an arbitrary image on the recording sheet.

Figure 3:
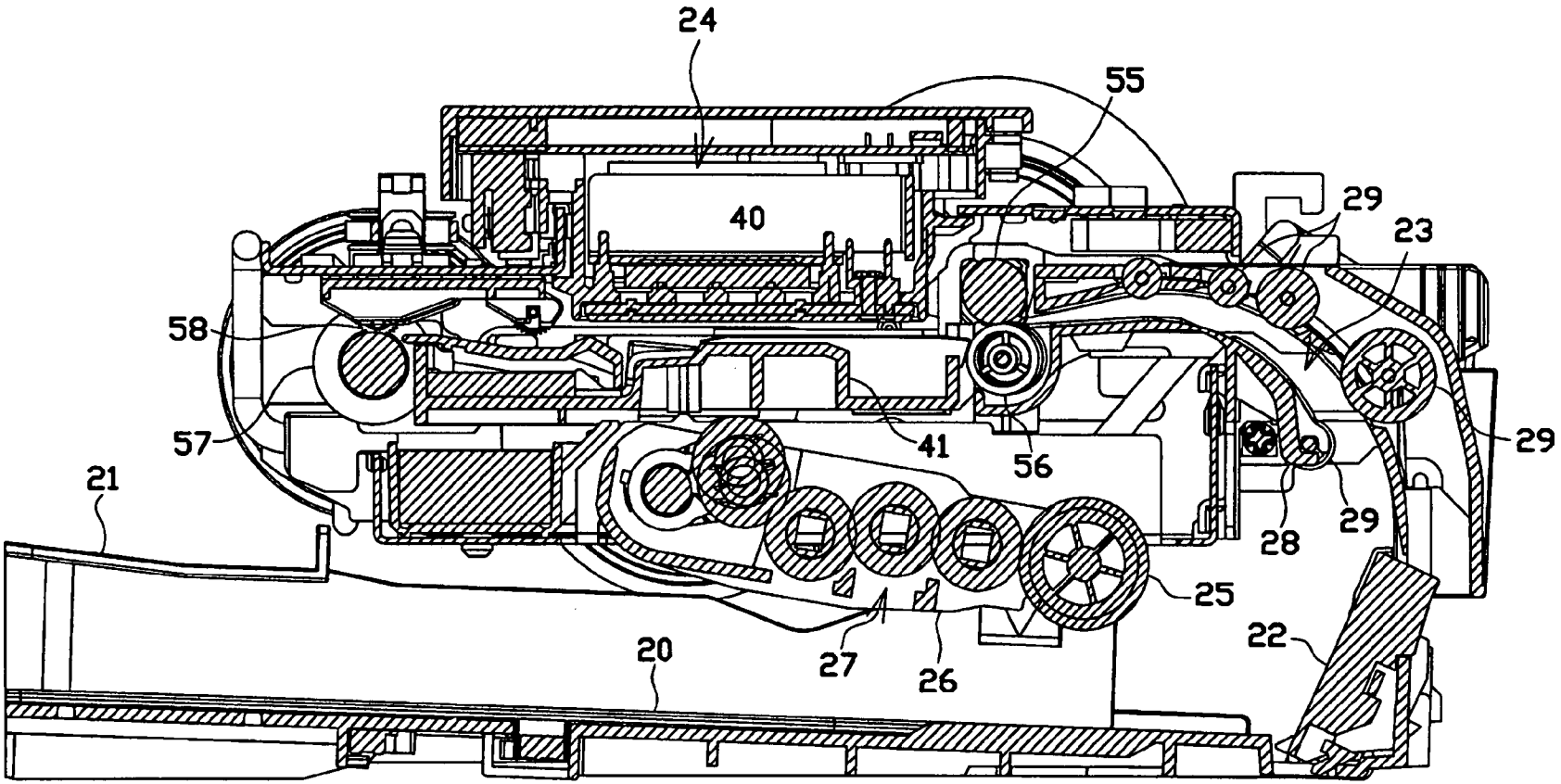
FIG. 3 is an enlarged cross sectional view showing a main structure of a printing portion of the composite machine of FIG. 1.

By referring next to FIGS. 2-8, there will be explained an internal structure of the composite machine 1, especially, a structure of the printing portion 2. As shown in FIGS. 2 and 3, at one end of the sheet-supply tray 20 disposed at the bottom part of the composite machine 1, which one end is remote from the front opening 2*a*, there is disposed an inclined sheet separator plate 22 which separates the recording sheets stacked on the sheet-supply tray 20 and guides the separated sheet upward. A sheet-feed path 23 is formed so as to extend upward from the inclined sheet separator plate 22. The sheet-feed path 23 initially extends upward, then turns toward the front side of the composite machine 1, so as to extend from the rear side toward the front side of the composite machine 1 while passing through an image recording portion 24 and finally reaching the sheet-discharge tray 21. Accordingly, the recording sheet accommodated in the sheet-supply tray 20 is fed from the same 20 to the image recording portion 24 while being guided through the sheet-feed path 23 so as to make a U-turn. After the recording sheet is subjected to a recording operation at the image recording portion 24, the recording sheet is discharged to the sheet-discharge tray 21.

As shown in FIG. 3, there is disposed, above the sheet-supply tray 20, a sheet-supply roller 25 for separating the recording sheets stacked on the sheet-supply tray 20 by one by and supplying the separated sheet toward the sheet-feed path 23. The sheet-supply roller 25 is supported by a free end of a roller support arm 26 which is pivotable upward and downward so as to move toward and away from the sheet-supply tray 20. The sheet-supply roller 25 is rotated by a drive force of a motor not shown transmitted from a drive-force transmission mechanism 27 constituted by including a plurality of gears meshing with each other.

The roller support arm 26 is pivotable at its proximal end upward and downward. In a standby condition, the roller support arm 26 is lifted upward as shown in FIG. 3 by a sheet-supply clutch, a spring and the like and pivotably moved downward upon supplying of the sheet. When the roller support arm 26 is pivotably moved downward, the sheet-supply roller 25 supported at the free end of the roller support arm 26 is brought into pressing contact with the recording sheets on the sheet-supply tray 20. In this state, the sheet-supply roller 25 rotates, whereby an uppermost one of the recording sheets on the sheet-supply tray 20 is fed toward the inclined sheet separator plate 22 owing to a friction force between the surface of the sheet-roller 25 and the recording sheet. The uppermost sheet fed toward the inclined sheet separator plate 22 abuts at its leading end on the same 22 and is guided upward so as to be fed into the sheet-feed path 23. When the uppermost sheet is fed by the sheet-supply roller 25, the sheet immediately below the uppermost sheet may be fed together with the uppermost sheet by friction or static electricity. The sheet in question, however, is prevented from being fed by abutting contact with the inclined sheet separator plate 22.

The sheet-feed path 23 is constituted by an outer guide surface and an inner guide surface facing each other with a predetermined distance interposed therebetween, except a portion thereof where the image recording portion 24 is disposed. For instance, on the rear side of the composite machine 1, the sheet-feed path 23 is constituted by the outer guide surface formed integrally with the frame of the composite machine 1 and the inner guide surface given by a guide member 28 fixed to the frame. At portions of the sheet-feed path 23 where the path 23 is curved, there are provided rolling bodies 29 such as rollers, such that each rolling body 29 is rotatable about its axis that coincides with the width direction of the sheet-deed path 23, with its roller surface exposed to the outer guide surface or the inner guide surface. The rolling bodies 29 assure smooth feeding of the recording sheet contacting the guide surfaces at portions of the sheet-feed path 23 where the path 23 is curved.

As shown in FIG. 3, the image recording portion 24 is provided on a downstream side of the sheet-feed path 23 after the path 23 makes a U-turn from the lower part to the upper part of the composite machine 1. The image recording portion 24 includes a recording head 40 which is moved in a predetermined direction. To the recording head 40, there are supplied inks of mutually different colors, i.e., cyan (C), magenta (M), yellow (Y) and black (K), from respective ink cartridges (as ink tanks) not shown in FIG. 3 disposed in the composite machine 1 separately from the recording head 40, through respective conduits such as tubes. The recording head 40 is moved while ejecting the inks, so that the image recording portion 24 performs recording of images on the recording sheet which is being fed on a platen 41.

Figure 4:
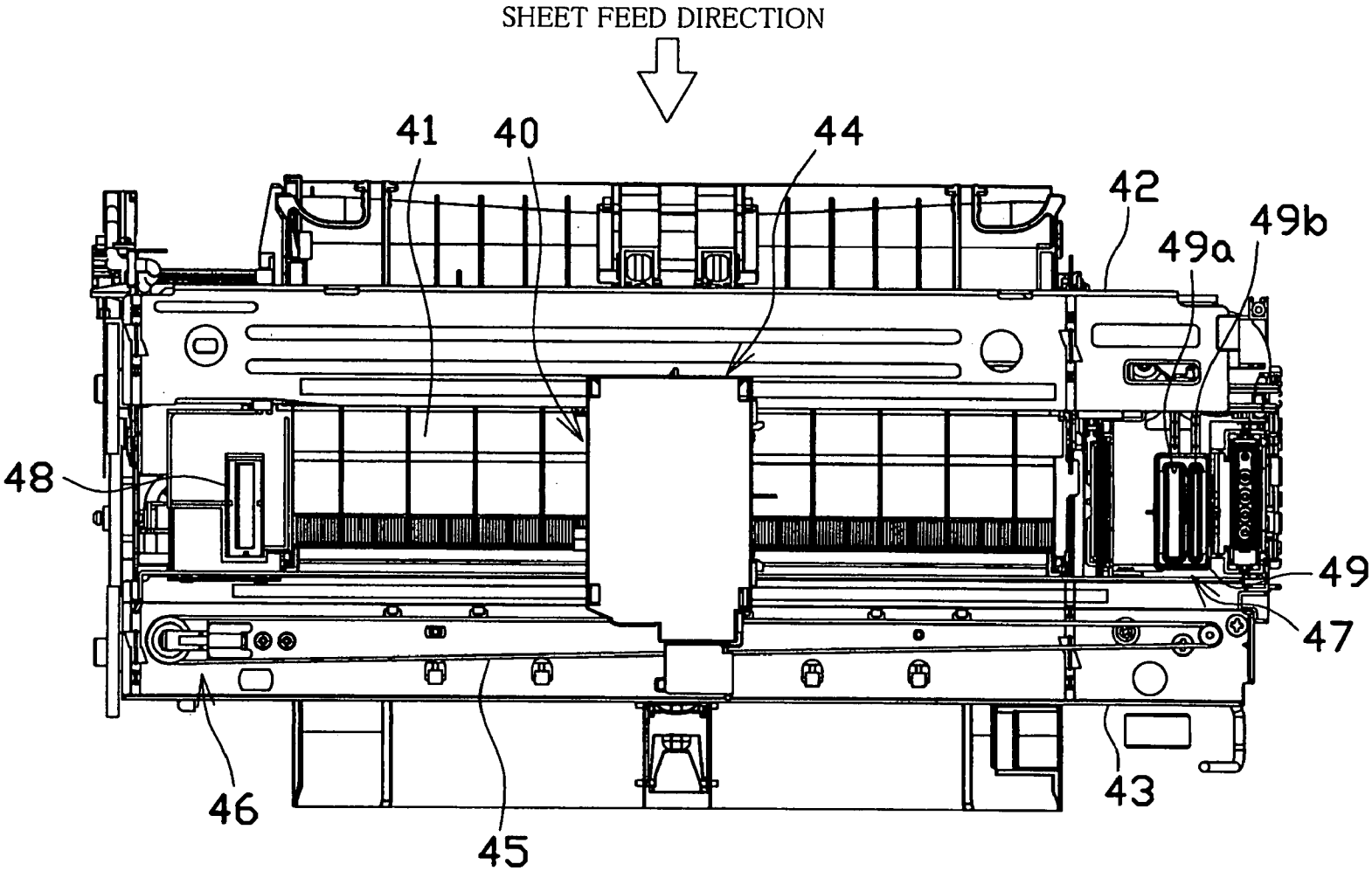
FIG. 4 is a partial plan view schematically showing a structure of an image recording portion of the composite machine of FIG. 1.

Described more specifically referring to FIG. 4, a carriage 44 is sidably disposed, above the sheet-feed path 23, bridging between a pair of guide members 42, 43 which extend in the width direction of the sheet-feed path 23 with a predetermined distance interposed therebetween in a sheet feed direction in which the recording sheet is fed. The guide member 43 disposed on a downstream side as seen in the sheet feed direction is provided with a belt driving mechanism 46 having an endless timing belt 45 in an annular form which is tensioned in the width direction of the sheet-feed path 23. The timing belt 45 is rotated by a drive force of a CR motor not shown, whereby the carriage 44 is slidably moved between the guide members 42, 43. The recoding head 40 is mounted on the thus arranged carriage 44, so as to be movable in the predetermined direction that coincides with the width direction of the sheet-feed path 23.

The platen 41 is disposed under the sheet-feed path 23 and at a central portion of the image recording portion 24 as seen in the moving direction of the recording head 40 in which the recording sheet passes. At one and the other of the opposite sides of the central portion of the image recording portion 24 where the recording sheet does not pass, namely, outside a recording range W1 by the recording head 40, there are provided a purge mechanism 47 as the ink sucking device (at the right side in FIG. 4) and a waste ink tray 48 (at the left side in FIG. 4).

The purge mechanism 47 includes: a cap 49 for covering a nozzle surface of the recording head 40 in which nozzles 50 are formed; a pump mechanism (not shown in FIG. 4) to be connected to the recording head 40 via the cap 49; and a moving mechanism (not shown in FIG. 4) for moving the cap 49 toward and away from the nozzle surface of the recording head 40. The cap 49 is arranged to fluid-tightly cover the nozzle surface of the recording head 40, and the pump mechanism is arranged to suck the inks from the recording head 40.

The cap 49 includes: a first cap portion 49*a* for fluid-tightly covering ink-ejection nozzles 50*a* of the nozzles 50 from which is ejected the black (K) ink; and a second cap portion 49*b* for fluid-tightly covering ink-ejection openings 50*a* of the nozzles 50 from which are ejected color inks, i.e., the cyan (C) ink, the magenta (M) ink and the yellow (Y) ink. Thus, the black ink and the color inks are prevented from mixing in the cap 49 when the cap 49 sucks the inks while fluid-tightly covering the nozzle surface of the recording head 40.

Although the pump mechanism and the moving mechanism of the purge mechanism 47 are not described in detail, there may be employed as the pump mechanism a system in which flexible tubes are successively compressed and squeezed by rollers and the like for flowing the air in the tubes, or other known pump mechanisms, and there may be employed as the moving mechanism any known mechanisms. The waste ink tray 48 is open upward corresponding to the nozzle surface of the recording head 40 for receiving and storing the inks to be ejected from the recording head 40 upon flushing which is not an actual printing operation performed on the recording sheet.

Figure 5:
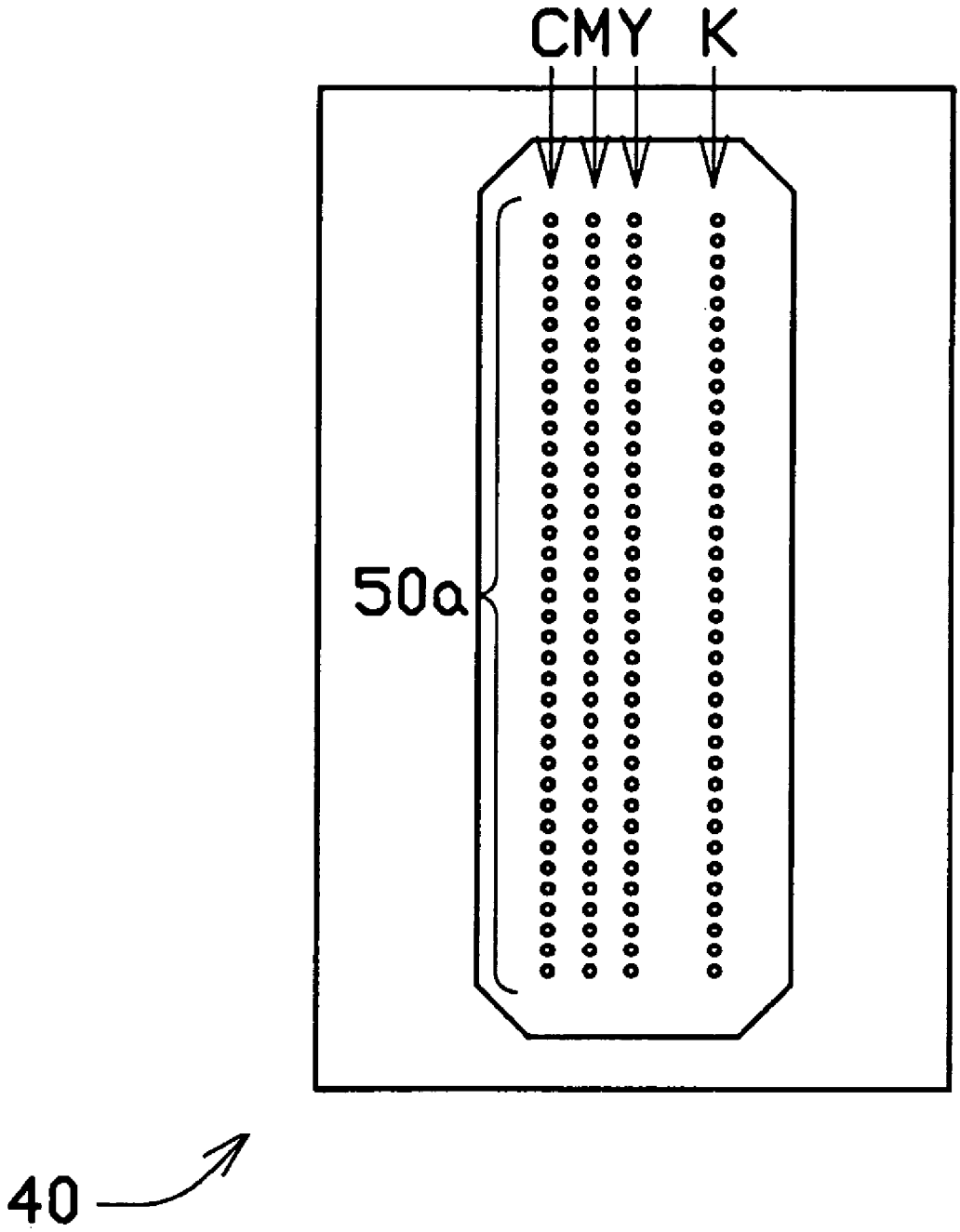
FIG. 5 is a bottom plan view of a recording head of the composite machine of FIG. 1 showing a lower surface of the recording head.

As shown in FIG. 5, the recording head 40 has the ink-ejection openings 50*a* formed on its lower surface so as to be arranged in rows corresponding to the respective inks of mutually different colors (C, M, Y and K) and extending in the sheet feed direction (in the vertical direction of FIG. 5). For instance, the leftmost row consists of the ink-ejection openings 50*a* for ejecting the cyan ink (C) arranged in series in the sheet feed direction. Similarly, the ink-ejection openings 50*a* for ejecting the other inks (M, Y and K) are arranged in series so as to form respective rows, whereby four rows in total respectively corresponding to the respective inks (C, M, Y and K) are formed. The spacing pitch of the ink-ejection openings 50*a* in the sheet feed direction and the number of the same 50*a* are suitably determined depending upon the resolution of images to be recorded, etc. Further, the number of the rows of the ink-ejection openings 50*a* may be increased and decreased in accordance with the number of the inks to be used.

Figure 6:
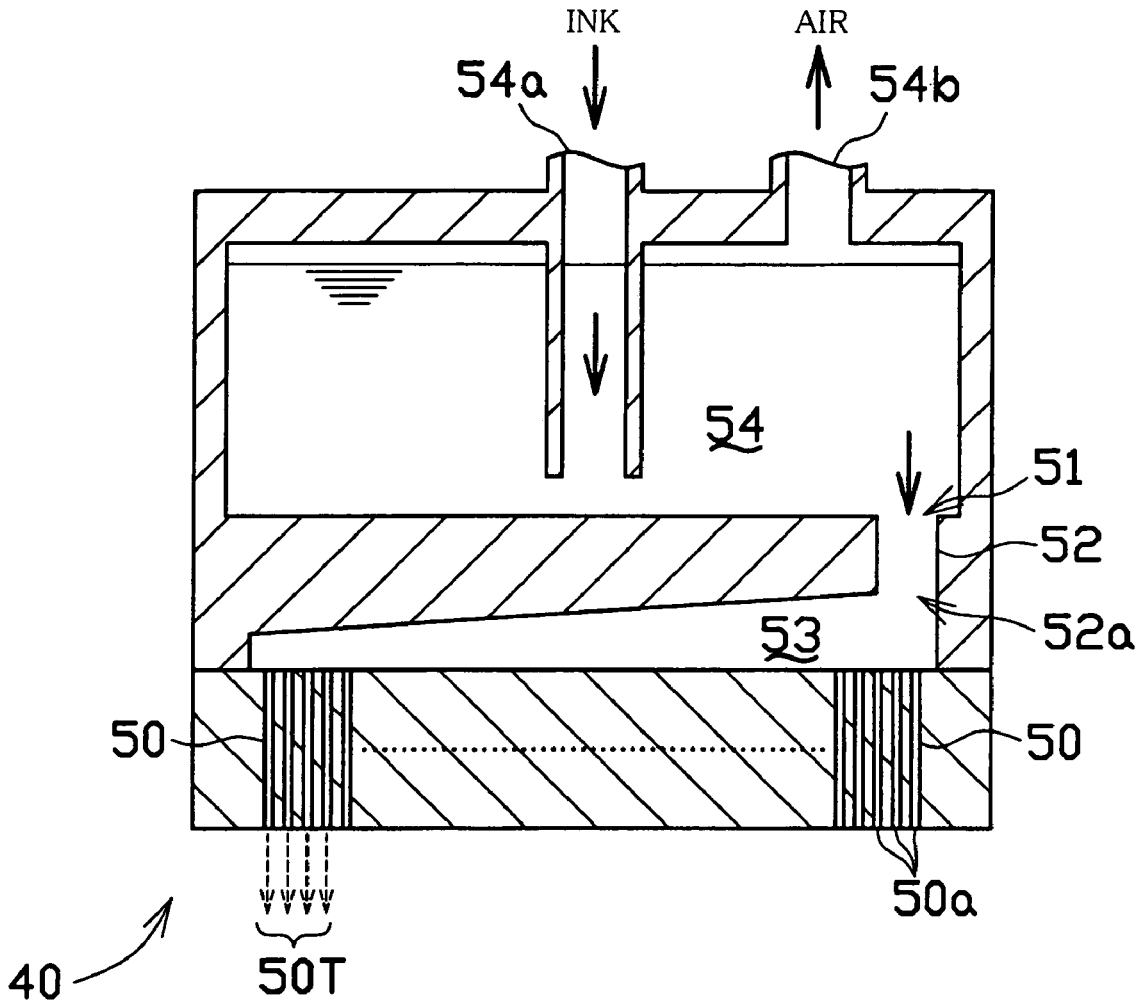
FIG. 6 is a vertical cross sectional view of the recording head.

As shown in FIG. 6, the recording head 40 is provided, at a lower portion thereof, with the plurality of nozzles 50 constituted by including the ink-ejection openings 50*a*, such that the nozzles 50 are arranged in rows along the sheet feed direction respectively corresponding to the respective inks of different colors (C, M, Y and K). Namely, the plurality of nozzles 50 are divided into four groups respectively corresponding to the inks of four different colors (C, M, Y and K). On the upper-end side of the nozzles 50 remote from the ink-ejection openings 50*a*, there are provided manifolds 51 which respectively correspond to the nozzles 50 of the respective groups. Each manifold 51 extends over the nozzles 50 of the corresponding group in a direction of extension of the row of the nozzles 50. Each manifold 51 is constituted by including an ink supply path 52 formed at one end of the row of the nozzles 50 of the corresponding group and a manifold chamber 53 as an ink chamber extending over the nozzles 50 of the corresponding group. Each ink supplied through the corresponding ink supply path 52 is distributed via the corresponding manifold chamber 53 to the nozzles 50 of the corresponding group.

Each manifold chamber 53 is defined by a lower wall surface in which are formed the nozzles 50 of the corresponding group and an upper wall surface confronting the lower surface. The upper wall surface is inclined such that a distance between the upper wall surface and the lower wall surface gradually decreases in a direction away from the corresponding ink supply path 52 toward a downstream end portion of the manifold chamber 53 as seen in a direction of the flow of the ink. Accordingly, the manifold chamber 53 has a cross sectional area that gradually decreases in the direction away from the ink supply path 52 toward the downstream end portion thereof. As a mechanism of ejecting, from the ink ejection openings 50*a* as ink droplets, the ink distributed into the nozzles 50 via the corresponding manifold 51, there may be employed one in which each nozzle 50 is defined by side walls made of a piezoelectric material and the ink droplets are ejected by deformation of the side walls made of the piezoelectric material, for instance. Any other known mechanism may be similarly employed.

Above the manifolds 51, there are disposed buffer tanks 54 which are provided for the respective inks of the four different colors (C, M, Y and K), like the nozzles 50 of the four groups and the manifolds 51. The inks of the four different colors are fed from the respective ink tanks not shown in FIG. 6 through the respective conduits such as tubes and supplied to the respective buffer tanks 54 via respective ink supply holes 54*a*. The buffer tanks 54 are provided for separating air bubbles contained in the inks so as to prevent the air bubbles from entering the nozzles 50 of the recording head 40. Described in detail, the inks are temporarily stored in the buffer tanks 54 without being supplied from the ink tanks directly to the nozzles 50, whereby the air bubbles generated in the inks flowing through the conduits such as tubes are separated from the inks, thus preventing the air bubbles from entering the nozzles 50. The air bubbles separated from the inks in the buffer tanks 54 are removed by sucking by a pump mechanism not shown in FIG. 6 through air-bubble discharge holes 54*b*.

The buffer tanks 54 communicate with the respective manifold chambers 53 through the respective ink supply paths 52. Accordingly, there is formed an ink supply route in which the inks supplied from the respective ink tanks are fed to the nozzles 50 of the corresponding groups via the corresponding buffer tanks 54 and manifolds 51. Thus, the recording head 40 is arranged to eject the inks of the four different colors (C, M, Y and K) as ink droplets from the corresponding ink ejection openings 50*a*.

As shown in FIG. 3, there are disposed, on the upstream side of the image recording portion 24, a pair of drive roller 55 and press roller 56 which cooperate with each other to hold therebetween the recording sheet that is being fed though the sheet-feed path 23 and feed the recording sheet on the platen 41. There are disposed, on the downstream side of the image recording portion 24, a pair of sheet-discharge roller 57 and spur roller 58 which cooperate with each other to feed the recording sheet on which images and the like have been recorded while holding therebetween the sheet. A drive force is transmitted from an LF motor not shown to the drive roller 55 and the sheet-discharge roller 57, whereby the recording sheet is intermittently fed at a suitable line feed pitch.

The press roller 56 is rotatably disposed while being biased toward the drive roller 55 with a suitable pressing force. Upon entering of the recording sheet between the drive roller 55 and the press roller 56, the press roller 56 is retracted from the drive roller 55 by an amount corresponding to the thickness of the recording sheet and cooperates with the drive roller 55 to hold the recording sheet therebetween, so that the rotary force of the drive roller 55 can be surely transmitted to the recording sheet. Though the spur roller 58 functions in a way similar to the press roller 56, the spur roller 58 has a rough surface with convexity and concavity for preventing deterioration of the images recorded on the recording sheet since the spur roller 58 contacts the recording sheet on which the images have been recorded.

The recording sheet held by and between the drive roller 55 and the press roller 56 is intermittently fed on the platen 41 at a suitable line feed pitch. The recording head 40 is moved during line feed movements, thereby recording images on the recording sheet starting from its leading end portion. The leading end portion of the recording sheet on which the images have been recorded is then held by and between the sheet-discharge roller 57 and the spur roller 58. Accordingly, the recording sheet is held by the sheet-discharge roller 57 and the spur roller 58 at its leading end portion and by the drive roller 55 and the press roller 56 at its trailing end portion. In this state, the recording sheet is intermittently fed at the suitable line feed pitch for recording performed by the recording head 40. As the recording sheet is further fed, the trailing end portion of the recording sheet passes through the drive roller 55 and the press roller 56 so as to be released from the two rollers 55, 56, and the recording sheet is fed by the sheet-discharge roller 57 and the spur roller 58 at the suitable line feed pitch for recording performed by the recording head 40. After the images have been recorded in a prescribed range of the recording sheet, the sheet-discharge roller 57 is continuously rotated, whereby the recording sheet held by the sheet-discharge roller 57 and the spur roller 58 is discharged to the sheet-discharge tray 21.

Figure 7:
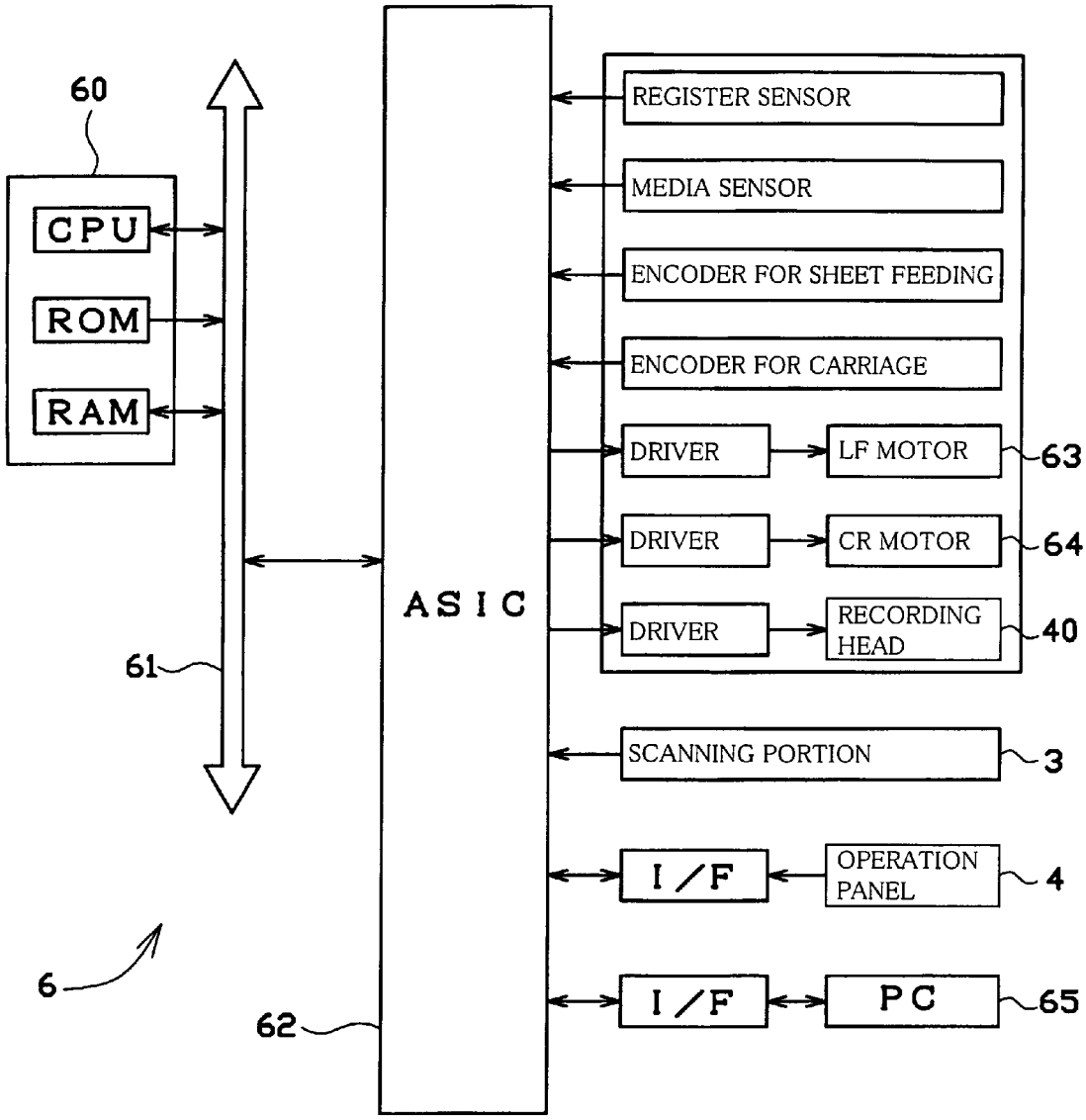
FIG. 7 is block diagram showing a structure of a control portion of the composite machine of FIG. 1.

FIG. 7 is a block diagram showing a structure of a control portion 6 of the composite machine 1 as a control device. As shown in FIG. 7, a central processing portion 60 constituted by including a CPU (Central Processing Unit), a ROM (Read Only Memory) and a RAM (Random Access Memory) is connected, via a bus 61 and an ASIC (Application Specific Integrated Circuit) 62, to various sensors, the scanning portion 3, the operation panel 4, etc., for data communication therebetween.

The central processing portion 60 performs, in accordance with information of various sensors, the control of rotation of an LF motor 63 for driving the drive roller 55 and a CR motor 64 for moving the recording head 40, the control of the purge mechanism 47, the scanning portion 3 and so on. As shown in FIG. 7, the central processing portion 60 outputs control signals to the LF motor 63, the CR motor 64, etc.

As mentioned above, the present composite machine 1 can perform recording of images and characters on the recording sheets on the basis of image data and character data transmitted from the computer (PC) 65 connected thereto, as well as on the basis of input made through the operation panel 4. For this end, there is provided an interface (I/F) for data communication with the computer 65. While one example of the structure of the control portion 6 is described, it is to be understood that the structure of the control portion 6 is not limited to that of the present embodiment.

Figure 8:
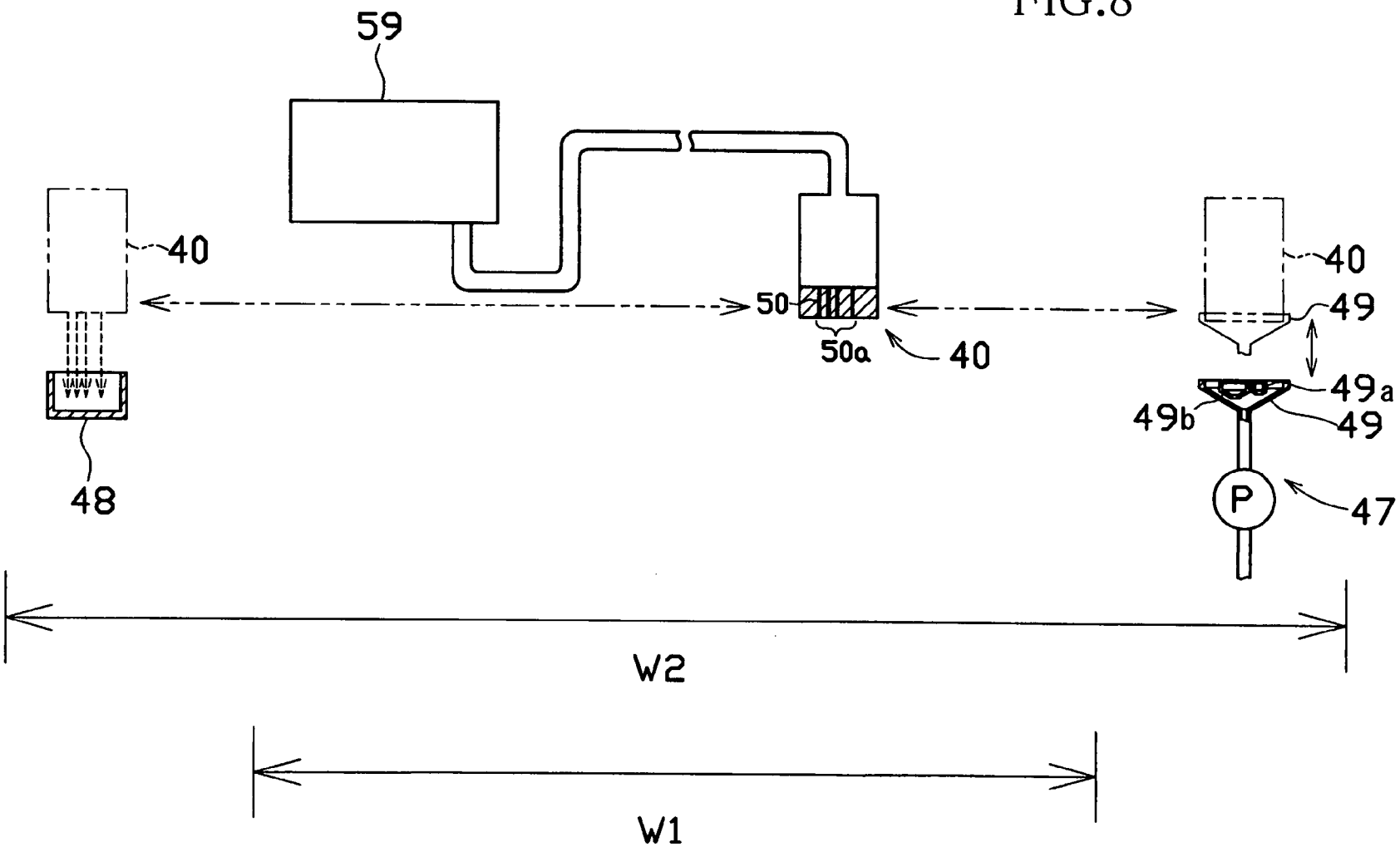
FIG. 8 is a schematic view showing an ink supply route from an ink tank to the recording head and the operational position of the recording head.

FIG. 8 schematically shows the ink supply route from the ink tanks 59 to the recording head 40 and the operational position of the recording head 40. As noted above, each of the inks supplied from the corresponding ink tank 59 to the recording head 40 through the corresponding conduit is stored in the corresponding buffer tank 54 where the air bubbles contained in the ink is separated, and then flows into the corresponding manifold chamber 53 via the corresponding ink supply path 52. The ink flowed into the manifold chamber 53 is distributed into the corresponding nozzles 50 and is finally ejected as ink droplets from the ink ejection openings 50*a* of the nozzles 50. The recording head 40 is moved in the recording range W1 while ejecting the ink droplets of the respective inks of the four different colors, so that images are recorded on the recording sheet that is being fed below the recording head 40.

As shown in FIG. 8, at one and the other of opposite ends of a head-moving range W2 of the recording head 40 which are located outside the recording range W1, the purge mechanism 47 and the waste ink tray 48 are respectively disposed. The purge mechanism 47 is for removing by sucking air bubbles and foreign substances from the nozzles 50, etc., of the recording head 40. In operation, the recording head 40 is moved to the right-side end of the head-moving region W2 (as seen in FIG. 8), and the cap 49 of the purge mechanism 47 is moved upward so as to come into close contact with the lower surface of the recording head 40 such that the ink ejection openings 50*a* are fluid-tightly covered. In this state, the inks are sucked from the nozzles 50, etc., of the recording head by a pump connected to the cap 49.

The waste ink tray 48 is for receiving the inks ejected from the recording head 40 in so-called flushing. In operation, the recording head 40 is moved to the left-side end of the head-moving region W2 (as seen in FIG. 8), and the inks are ejected toward the waste ink tray 48. The locations of the purge mechanism 47 and the waste ink tray 48 are not particularly limited. The purge mechanism 47 may be disposed at the left-side end while the waste ink tray 48 may be disposed at the right-side end. Both of the purge mechanism 47 and the waste ink tray 48 may be disposed at one of the right-side and left-side ends.

In general, the composite machine 1 has been subjected to a recording operation performed in factories prior to shipping thereof for checking the ink ejecting performance of the composite machine 1. In the recording operation, the ink tanks are actually installed and test patterns or the like are recorded. Accordingly, the inks are filled in the nozzles 50, the manifolds 51 and the buffer tanks 54 of the recording head 40. The composite machine 1 is shipped with the recording head 40 covered with the cap 49 for preventing contamination due to ink leakage and drying of the inks in the nozzles 50.

The ink which has leaked from the ink ejection openings 50*a* of the corresponding nozzles 50 during transportation or storage after shipment gather or collect around the ink ejection openings 50*a* and mix with another ink which has similarly leaked from the adjacent ink ejection openings 50*a*, so that the mixed ink enters insides of the nozzles 91 from the ink ejection openings 50*a* thereof. The mixed ink entered the nozzles 50 may be diffused into the buffer tanks 54. To avoid the contamination with the mixed ink during the transportation period or the storage period, there are conducted an initial ink sucking action and an initial ink ejecting action upon initial working of the composite machine 1, namely, upon initial use of the composite machine 1 by a user after the manufacture thereof or the quality inspection conducted thereon through the transportation period or the storage period.

Hereinafter, by referring to the flow chart of FIG. 9, there will be explained a method of cleaning of the recording head 40 by the initial ink sucking action and the initial ink ejecting action performed upon the initial working of the composite machine 1. The initial ink ejecting action includes an all-nozzle-ink-ejecting action and a partial-nozzle-ink-ejecting action that will be described in greater detail.

Figure 9:
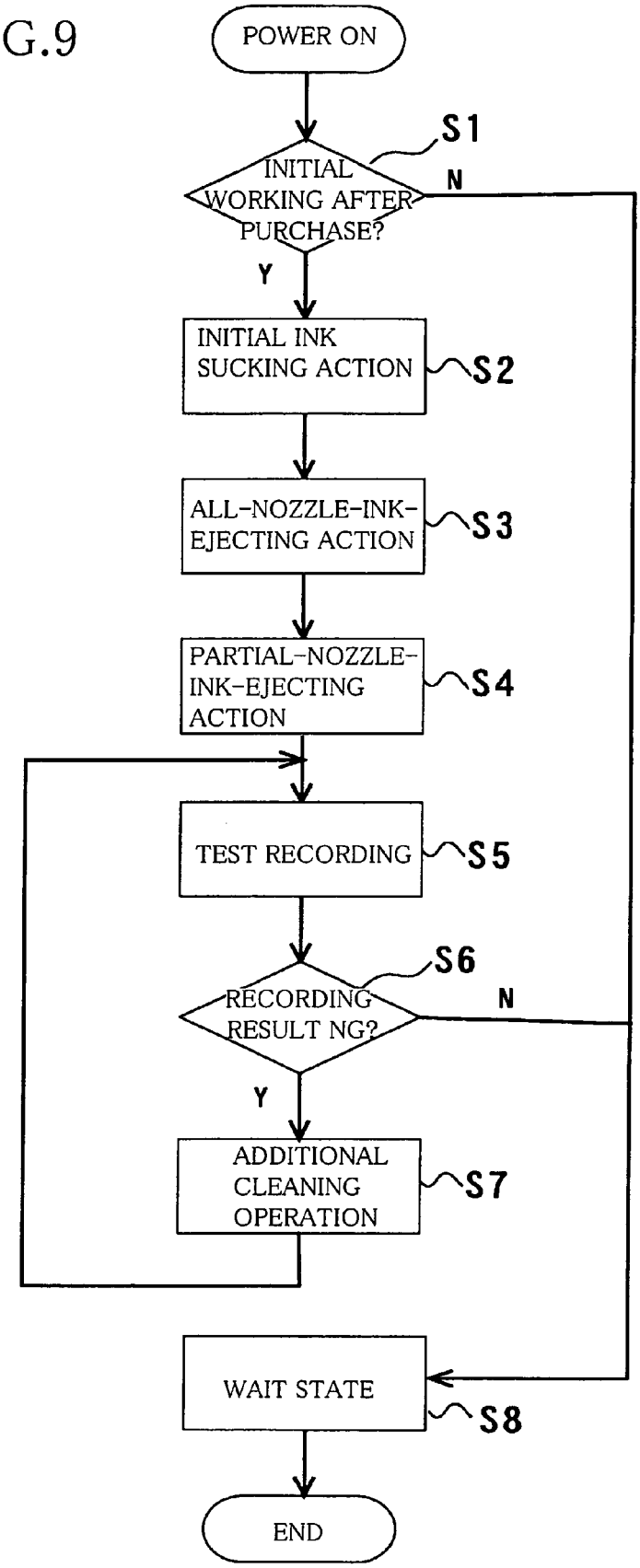
FIG. 9 is a flow chart showing a head cleaning operation executed upon initial working of the composite machine of FIG. 1.

The flow chart of FIG. 9 starts with step S1 in which the central processing portion 60 of the composite machine 1 judges upon turning on a power of the composite machine 1 whether or not the power is initially turned on after purchase of the composite machine 1, that is, whether or not the composite machine 1 is about to be subjected to an initial working. (Hereinafter, "step" is omitted where appropriate.) It is possible to make such a judgment by resetting, prior to packing of the composite machine 1 in factories after its quality inspection, a memory in which is recorded its operation history so far or a power-on counter.

When it is judged that the power is initially turned on, namely, the composite machine 1 is about to be subjected to the initial working, the cleaning operation of cleaning the recording head 40 (hereinafter may be referred to as "head cleaning operation") is performed by executing the initial ink sucking action and the initial ink ejecting action. When it is judged that the power is not initially turned on, the composite machine 1 is placed into a wait state for performing recording (S8). Accordingly, when the turning on of the power is not initial one, the composite machine 1 is ready to perform recording without executing the cleaning operation of the recording head 40.

The head cleaning operation does not start at the same time when the power is turned on. Where the composite machine 1 is connected to the computer, for instance, an electric signal indicative of the initial working of the composite machine 1 is transmitted from the same 1 to the computer, whereby an indication is made on a display of the computer by a software such as a printer driver installed on the computer, which indication encourages execution of the head cleaning operation by the initial ink sucking action and the initial ink ejecting action. When the user acknowledges the execution of the head cleaning operation by clicking "OK" on the display, for instance, the computer sends the control portion 6 an electric signal indicative of the initiation of the head cleaning operation. In response to the electric signal, the control portion 6 starts execution of the head cleaning operation. During the head cleaning operation, there is suitably made, on the display, an indication which indicates that the head cleaning operation is now in progress or an indication which indicates a state of progress of the head cleaning operation. Thus, the head cleaning operation is not initiated at the same time when the power is initially turned on. Instead, the user first recognizes the execution of the head cleaning operation and the head cleaning operation is then executed after acknowledgement by the user, so that the user is allowed to make preparations necessary for the head cleaning operation such as releasing of fixation of the recording head 40, connecting of ink cartridges. The settings such as indication on the display by the software such as the printer driver are design matters and are suitably determined by considering the operating environment of the composite machine 1, etc. In the present embodiment, the display of the computer functions as a display device and the input members such as a mouse and a keyboard of the computer function as an input device. The head cleaning operation may be performed only by the composite device 1 without being connected to the computer, using the liquid crystal display portion and the control keys of the operation panel 4 as the display device and the input device, respectively.

As the head cleaning operation performed upon the initial working of the composite machine 1, the purge mechanism 47 executes the initial ink sucking action (S2) in which the inks in the manifold chambers 53 and the buffer tanks 54 are sucked through the nozzles 50. Described in detail with reference to FIG. 8, the recording head 40 is first moved to the right-side end of the head-moving range W2, and the cap 49 of the purge mechanism 47 is moved upward so as to come into close contact with the lower surface of the recording head 40 such that the ink ejection openings 50*a* are fluid-tightly covered. In this state, the inks are sucked from the nozzles 50, etc., by the pump connected to the cap 49.

The ink sucking action is carried out in the following manner: Initially, the ink sucking action is performed by the pump in the first cap portion 49*a* which covers the black-ink ejection openings 50*a* for ejecting the black ink, so that a predetermined amount of the black ink is sucked through the corresponding nozzles 50 from the corresponding manifold chamber 53 and buffer tank 54 which are filled with the black ink. Thereafter, the ink sucking action is performed by the pump in the second cap portion 49*b* which covers other ink ejection openings 50*a* except the black-ink ejection openings 50*a*, which other ink ejection openings 50*a* are for ejecting the color inks C, M and Y. As a result, a predetermined amount of each of the color inks C, M and Y is sucked through the corresponding nozzles 50 from the corresponding manifold chamber 53 and buffer tank 54 which are filled with the corresponding color ink. By sucking the color inks C, M and Y at one time as described above, the ink sucking action can be promptly performed.

The suction of the black ink and the suction of the color inks C, M and Y are performed independently of each other for the purpose of preventing mixing of the black ink and the color inks C, M and Y within the cap 49. Where there is a little fear of mixing, the suction of the black ink and the suction of the color inks C, M and Y may be performed concurrently. Further, the suction of the black ink and the suction of the color inks C, M and Y may be alternately performed. Moreover, the initial ink sucking action may be constituted by suitably combining the independent suction and the concurrent suction. Namely, the initial ink sucking action is not limited to that according to the present embodiment. By performing the initial ink sucking action described above, the mixed ink entered the manifold chambers 53 and the buffer tanks 54 through the nozzles 50 during the transportation period or the storage period can be removed by sucking.

After the initial ink sucking action, the all-nozzle-ink-ejecting action (S3) is executed for all nozzles 50 to eject a corresponding one of the inks (C, M, Y and K) from each of all nozzles 50. Described in detail with reference to FIG. 8, the recording head 40 is moved to the left-side end of the head-moving region W2. In this position, a predetermined amount of each of the inks C, M, Y and K is ejected to the waste ink tray 48. In such an ink ejecting action, each ink is ejected at prescribed shots such that an amount of the ink droplet for each shot to be ejected from each ink ejection opening 50*a* of each nozzle 50 is set to be a predetermined amount. The mixed ink remaining in the nozzles and so on after the initial ink sucking action is ejected by the all-nozzle-ink-discharging action.

The amount of the ink droplet for each shot and the number of total shots in the all-nozzle-ink-ejecting action are determined by taking into account an amount which is normally required to discharge the mixed ink. Since the partial-nozzle-ink-ejecting action (that will be explained later) is subsequently executed, the amount to be ejected in the all-nozzle-ink-ejecting action need not be equal to the amount required for completely discharging the mixed ink from all manifold chambers 53 and all nozzles 50. Therefore, in the all-nozzle-ink-ejecting action, the ink ejection of 48000 shots is performed with an amount of the ink droplet for each shot from each nozzle 50 being set at 35 pl, for instance.

Where the ink ejection of a prescribed number of shots is executed in the all-nozzle-ink-ejecting action, the total shots may be suitably divided into a plural sets and the ink ejection with each set of shots may be repeatedly executed with a prescribed time interval between any two successive executions of the ink ejection with each set of shots. When the ink ejection from the nozzles 50 of the recording head 40 is continuously executed, the air bubbles generated in each ink undesirably grow, thereby causing ink ejection failure from the nozzles 50. Where the ink ejection is executed as described above, however, it is possible to inhibit the growth of the air bubbles in each ink due to the continuous ink ejection. In this connection, the number of shots in each set is desirably made equal to a maximum number of shots with which one ink is ejected from one nozzle per unit amount of the movement of the recording head 40, from the standpoint of easiness of control. The time interval during which the ink ejection is not executed is about several tens of fractions of a second. Accordingly, where the all-nozzle-ink-ejecting action of 48000 shots is executed with the amount of the ink droplet for each shot from each nozzle 50 being set at 35 pl as described above, the ink ejection is executed 12 times if the maximum number of shots with which one ink is ejected from one nozzle per unit amount of the movement of the recording head 40 is equal to 4000. Further, the above-mentioned time interval may conform to a line feed time of the recording head 40.

After the all-nozzle-ink-ejecting action, the partial-nozzle-ink-ejecting action (S4) is executed for at least one specific nozzle to eject a corresponding one of the inks from each specific nozzle at a plurality of shots. The at least one specific nozzle is one from which the corresponding ink is less likely to be sucked in the initial ink sucking action described above. For instance, in the present embodiment, the at least one specific nozzle includes nozzles that communicate with an end portion of each manifold chamber 53, which end portion is remote from a corresponding ink inlet 52*a* through which the corresponding ink is supplied from the corresponding buffer tank 54. The end portion may be interpreted as including an endmost portion of each manifold chamber 53 and its vicinity.

More specifically explained with reference to FIG. 6, each of the inks (C, M, Y and K) supplied from the respective ink tanks flows from the corresponding buffer tank 54 to the corresponding manifold chamber 53 via the corresponding ink supply path 52 of the corresponding manifold 51. The ink which flows into the manifold chamber 53 is distributed into the corresponding nozzles 50. In such a flow of the ink, the wall of the manifold 51 causes resistance to the ink flow. That is, the resistance to the ink flow is small at an upstream portion of the manifold chamber 53 near to the ink inlet 52*a* communicating with the ink supply path 52 and therefore the ink flow is fast at the upstream portion whereas the resistance to the ink flow is large at a downstream portion of the manifold chamber 53 remote from the ink inlet 52*a* and therefore the ink flow is slow. Accordingly, in the above-mentioned ink sucking action, the mixed ink is likely to be replaced, at the upstream portion of the manifold chamber 53, with new and fresh ink supplied from the ink tank while the mixed ink is less likely to be replaced at the downstream portion. Further, the ink tends to stay or remain on the inclined wall surface of the manifold chamber 53 confronting the nozzles 50. Accordingly, the nozzles 50 which communicate with the downstream portion of the manifold chamber 53 and which confront the inclined wall surface with a relatively small spacing distance therebetween are susceptible to the staying ink.

In the present embodiment, therefore, the partial-nozzle-ink-ejecting action is executed for the nozzles 50 communicating with the downstream portion of each manifold chamber 53 remote from the corresponding ink inlet 52*a*, preferably, four nozzles 50T (FIG. 6) located in the vicinity of the downstream portion of each manifold chamber 53, as the at least one specific nozzle. Because each ink is ejected, in the partial-nozzle-ink-ejecting action, only from the specific nozzles 50T communicating with the downstream portion of the corresponding manifold chamber 53, the ink is not ejected from other nozzles except the specific nozzles. Therefore, the entire ink consumption amount in the head cleaning operation can be reduced.

As in the above-mentioned all-nozzle-ink-ejecting action, in the partial-nozzle-ink-ejecting action, each ink is ejected at prescribed shots such that an amount of the ink droplet for each shot to be ejected from each specific nozzle 50T is set to be a predetermined amount. The amount of the ink droplet for each shot and the number of total shots in the partial-nozzle-ink-ejecting action are determined by taking into account the amount which is normally required to discharge the mixed ink. Since, in the partial-nozzle-ink-ejecting action, each ink is not ejected from the nozzles except the specific nozzles 50T communicating with the downstream portion of each manifold chamber 53, the entire ink consumption amount in the head cleaning operation conducted upon the initial working does not considerably increase even if each ink is ejected from the corresponding specific nozzles 50T in an amount sufficient for discharging the mixed ink. Therefore, in the partial-nozzle-ink-ejecting action, the ink ejection of 112000 shots is performed with an amount of the ink droplet for each shot from each specific nozzle 50T being set at 35 pl, for instance.

As in the above-mentioned all-nozzle-ink-ejecting action, in this initial-nozzle-ink-ejecting action, where the total shots are suitably divided into a plural sets and the ink ejection with each set of shots is repeatedly executed with a prescribed time interval between any two successive executions of the ink ejection with each set of shots, the growth of the air bubbles in each ink due to continuous execution of the ink ejection can be inhibited. In this connection, the number of shots in each set is desirably made equal to the maximum number of shots with which one ink is ejected from one nozzle per unit amount of the movement of the recording head 40, from the standpoint of easiness of control. Accordingly, where the partial-ink-ejecting action of 112000 shots is executed with the amount of the ink droplet for each shot from each specific nozzle 50T being set at 35 pl, the ink ejection is executed 28 times if the maximum number of shots with which one ink is ejected from one nozzle per unit amount of the movement of the recording head 40 is equal to 4000. Further, the above-mentioned time interval may conform to the line feed time of the recording head 40.

Upon termination of the partial-nozzle-ink-ejecting action, an electric signal indicative of the termination of the head cleaning operation is transmitted from the composite machine 1 to the computer, whereby an indication is made on the display of the computer by the software such as the printer driver, which indication indicates the termination of the head cleaning operation and which encourages execution of test recording. When the user acknowledges by clicking "OK" on the display, for instance, the computer sends the control portion 6 an electric signal indicative of the execution of the test recording. In response to the electric signal, the control portion 6 controls the recording head 40 to execute the test recording (S5). There may be employed, as test patterns to be used in the test recording, any suitable one conventionally used for color ink-jet recording apparatus and the like. Thus, the user first recognizes the execution of the test recording after the head cleaning operation and the test recording is then executed after acknowledgement by the user, so that the user is allowed to make preparations necessary for the test recording such as setting of the recording sheets. It is desirable to execute, if possible, the test recording, in order to judge the result of the head cleaning operation. However, the test recording may be omitted when the user judges that the execution of the test recording is not necessary. In this case, the composite machine 1 is placed into the wait state upon the termination of the head cleaning operation. As noted above, the indication which indicates the termination of the head cleaning operation and which encourages the test recording may be made on the liquid crystal display portion of the operation panel 4 of the composite machine 1, in place of the display of the computer. Similarly, the input for allowing the test recording may be made through the control buttons of the operation panel 4, in place of the input members. Where the test recording is executed by the composite machine 1 per se without being connected to the computer, the patterns for the test recording may be stored in advance in the ROM of the central processing portion 60, etc.

Upon termination of the test recording, an electric signal indicative of the termination of the test recording is transmitted from the composite machine 1 to the computer, whereby an indication is made on the display of the computer by the software such as the printer driver, which indication indicates the termination of the test recording. Through the indication, it is inputted whether the result of the test recording is good or bad (S6). The user checks the recording sheet on which the test recording has been performed and inputs, into the computer, the result of the test recording by clicking, for instance. Where there is made an input that the result of the test recording is bad, an indication is made on the display of the computer by the software, which indication encourages execution of an additional cleaning operation explained below. When the user acknowledges the execution of the additional cleaning operation by clicking "OK" on the display, an electric signal indicative of initiation of the additional cleaning operation is transmitted from the computer to the control portion 6 of the composite machine 1. In response to the electric signal, the control portion 6 controls the recording head 40 to start the additional cleaning operation (S7).

The additional cleaning operation may be the same as the head cleaning operation described above that includes the initial ink sucking action and the initial ink ejecting action including the all-nozzle-ink-ejecting action and the partial-nozzle-ink-ejecting action. Alternatively, the additional cleaning operation may be different from the head cleaning operation described above. For instance, the additional cleaning operation may include only the initial ink sucking action without the initial ink ejecting action or only the all-nozzle-ink-ejecting action without the partial-nozzle-ink-ejecting action. During the additional cleaning operation, there is suitably made, on the display, an indication which indicates that the additional cleaning operation is now in progress or an indication which indicates a state of progress of the additional cleaning operation. Thus, even when the result of the test recording is bad, the additional cleaning operation is not immediately executed. Instead, the user first recognizes the execution of the additional cleaning operation and the additional cleaning operation is then executed after acknowledgement by the user, so that the user is allowed to make preparations necessary for the additional cleaning operation. It is desirable to execute, if possible, the additional cleaning operation, in order to completely remove the mixed ink from the recording head 40. However, the additional cleaning operation may be omitted if the user accepts somewhat lowered quality level judged based on the results of the test recording and the mixed ink is removed by use of the inks in image recording. In this case, the composite machine 1 is placed into the wait state upon the termination of the test recording. As noted above, the indication which encourages the additional cleaning operation may be made on the liquid crystal display portion of the operation panel 4 of the composite machine 1, in place of the display of the computer. Similarly, the input for allowing the additional cleaning operation may be made through the control buttons of the operation panel 4, in place of the input members.

After the additional cleaning operation, the test recording is encouraged to be executed again, and the test recording is executed. When there is made an input that the result of the test recording is good, the composite machine 1 is placed into the wait state for image recording (S8), whereby the cleaning operation of the recording head 40 upon the initial working of the composite machine 1 is completed. Where there is made an input that the result of the test recording performed after the first execution of the head cleaning operation is good, the composite machine 1 is placed into the wait state (S8) without executing the additional cleaning operation, whereby the cleaning operation of the recording head 40 upon the initial working of the composite machine 1 is completed and the composite machine 1 is ready to perform recording immediately after the head cleaning operation.

In the present composite machine 1 constructed as described above, the mixed ink which have entered the nozzles 50, the manifold chambers 53 and the buffer tanks 54 during its transportation or storage before the initial working thereof can be removed by the initial ink sucking action. Further, the mixed ink that cannot be removed by the initial ink sucking action can be completely removed by the all-nozzle-ink-ejecting action and the partial-nozzle-ink-ejecting action which is executed for the specific nozzles 50T described above while reducing the entire ink consumption amount in the initial ink ejecting action.

Figure 12:
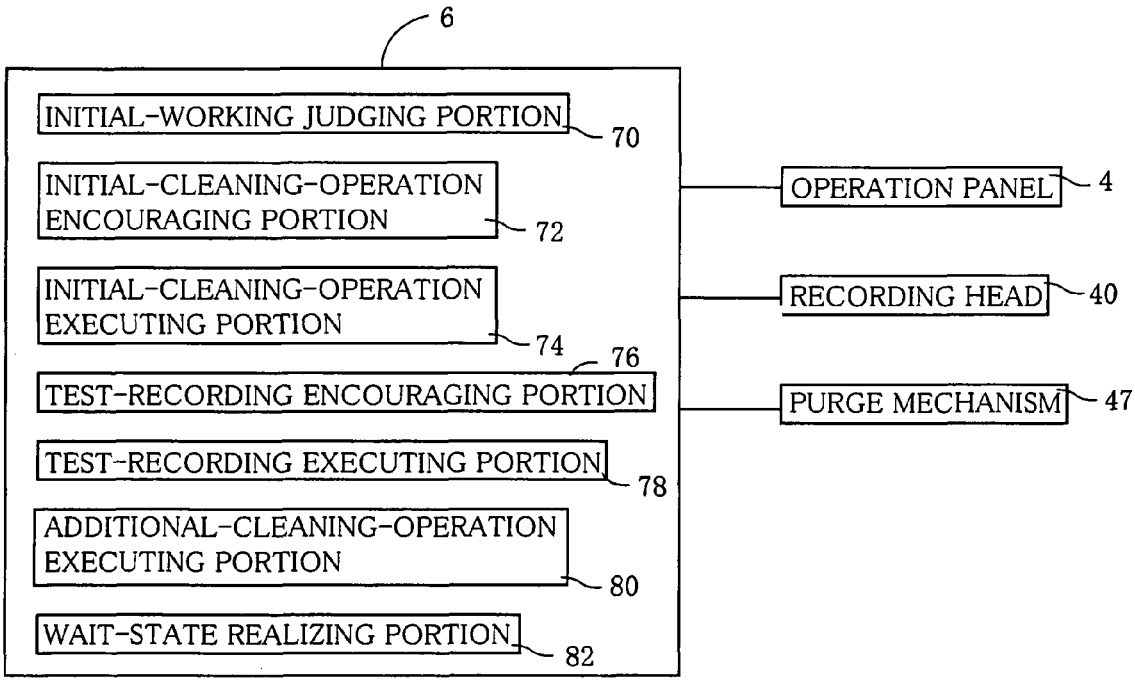
FIG. 12 is a block diagram showing functional portions of the control portion of the composite machine of FIG. 1.
Figure 13:
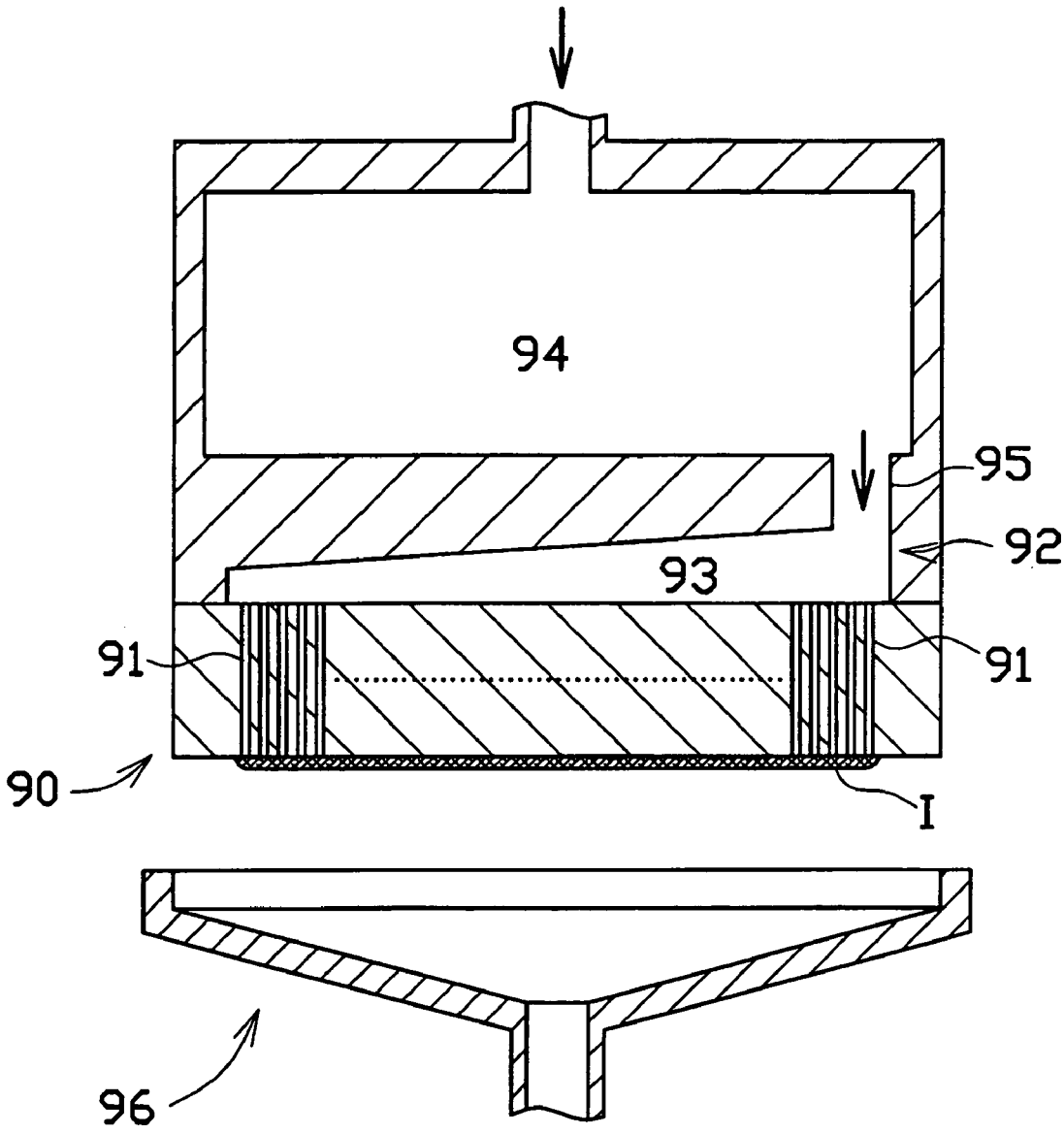
FIG. 13 is a vertical cross sectional view of a recording head of a conventional ink-jet recording apparatus.

Referring next to the block diagram of FIG. 12, there will be explained a functional structure of the control portion 6 as the control device for controlling the present composite machine 1. As shown in FIG. 12, it may be considered that the control portion 6 includes various functional portions such as an initial-working judging portion 70, an initial-cleaning-operation encouraging portion 72, an initial-cleaning-operation executing portion 74, a test-recording encouraging portion 76, a test-recording executing portion 78, an additional-cleaning-operation executing portion 80 and a wait-state realizing portion 82. More specifically explained, the initial-working judging portion 70 is a functional portion which executes the processing in S1 described above. The initial-cleaning-operation encouraging portion 72 is s functional portion which makes the indication after S1 that encourages the execution of the initial cleaning operation. The initial-cleaning-operation executing portion 74 is a functional portion which executes the initial cleaning operation, namely, the processing in S2, S3 and S4. The test-recording encouraging portion 76 is a functional portion which makes the indication after S4 that encourages the execution of the test recording. The test-recording executing portion 78 is a functional portion which executes the test recording, namely, the processing in S5. the additional-cleaning-operation executing portion 80 is a functional portion which executes the additional cleaning operation, namely the processing in S7. The wait-state realizing portion 82 is a functional portion which realizes the wait state of the composite machine 1, namely, the processing in S8.

Second Embodiment

Figure 10:
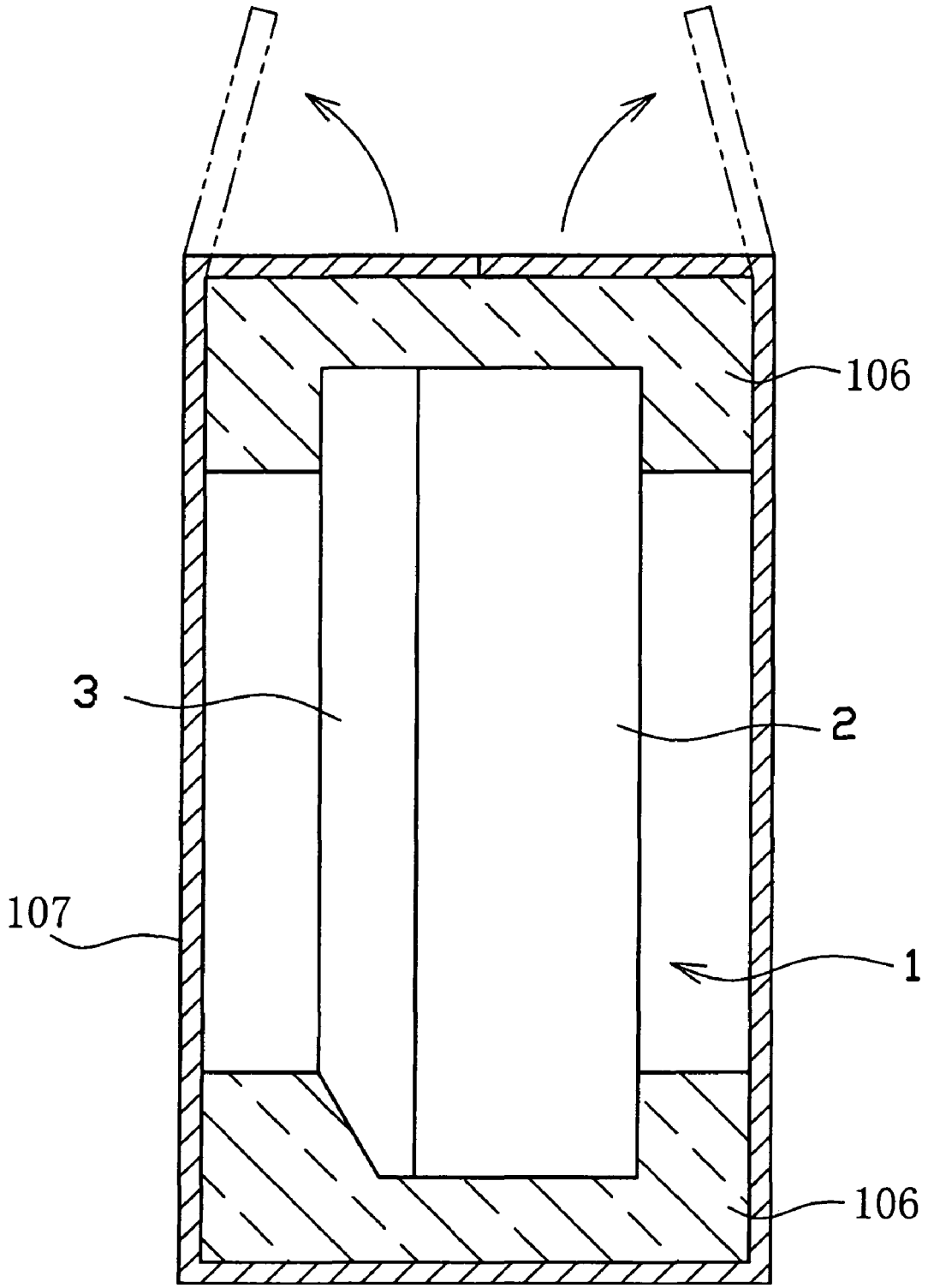
FIG. 10 is a packing state of the composite machine of FIG. 1.
Figure 11:
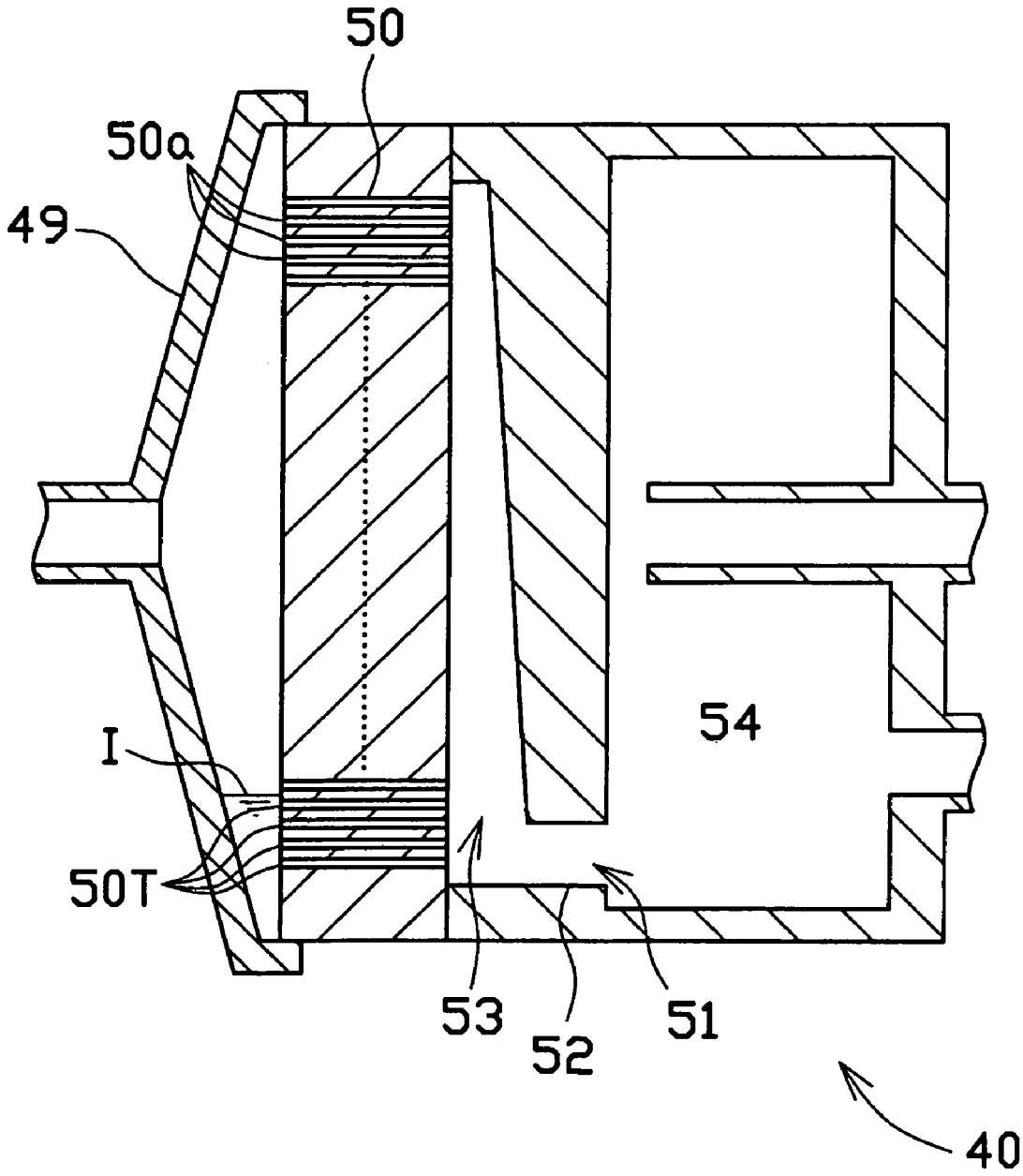
FIG. 11 is a view showing a posture of the recording head in the packing state of FIG. 10.

Referring next to FIGS. 10 and 11, there will be explained a second embodiment of the invention. FIG. 10 shows the composite machine 1 in a packed state before shipping. As shown in FIG. 10, the composite machine 1 is accommodated in a box 107 made of corrugated cardboard while being protected by cushioning members 106 made of a foamed synthetic resin or the like such that the cushioning members 106 are disposed to surround the composite machine 1. The box 107 is closed by means of staples, tapes and the like, so that the composite machine 1 is packed in the box 107. In packing the composite machine 1 as described above, the composite machine 1 may be positioned in the box 107 such that its front and rear extend in a vertical direction. As shown in FIG. 1, the composite machine 1 is wide and slim type with its width and depth being made larger than its height and has a generally rectangular parallelepiped configuration. Accordingly, by accommodating the composite machine 1 in the box 107 with its front facing downward and its rear facing upward as shown in FIG. 10, it is possible to reduce the floor space when the boxes 107 are stacked on a palette used in transportation, thereby enhancing the loading efficiency.

Where the composite machine 1 is packed as described above, the recording head 40 assumes a posture shown in FIG. 11 in which the ink ejection openings 50*a* of the nozzles 50 face sideways and the rows of the nozzles 50 for the respective inks of the different colors extend in the vertical direction. In general, the composite machine 1 has been subjected to a recording operation in factories prior to shipment thereof for the purpose of confirming or checking its ink ejecting performance. In the recording operation, the ink tanks are actually installed on the machine to perform a recording operation of recording test patterns, for instance. Accordingly, the nozzles 50, the manifolds 51, the buffer tanks 54 are filled with the respective inks. Further, the composite machine 1 is shipped in a condition that the recording head 40 is covered with the cap 49 for preventing contamination due to ink leakage and drying of the inks in the nozzles 50.

With the recording head 40 kept in the condition, the inks which leak from the ink ejection nozzles 50*a* of the nozzles 50 during transportation or storage after shipment drop and mix with each other in the cap 49. In this case, the thus mixed ink I enters the insides of the nozzles 50 from the ink ejection openings 50*a*. Further, the mixed ink I flowed into the nozzles 50 may diffuse into the buffer tanks 54. This second embodiment relates to a head cleaning method to be practiced when the composite machine 1 is initially used by users after the manufacture thereof or the quality inspection conducted thereon through the transportation or storage period, for the purpose of avoiding contamination due to the mixed ink during the transportation or storage period.

Because the second embodiment differs from the illustrated first embodiment only in the at least one specific nozzle 50T in the partial-nozzle-ink-ejecting action (S4), and other processing such as the initial ink sucking action and the all-nozzle-ink-ejecting action and the structure of the composite machine 1 are the same as those in the first embodiment, the following explanation is limited to that different portion.

In the second embodiment, the at least one specific nozzle 50T is constituted by the nozzles 50 located at a lower portion of the recording head 40 which assumes the posture shown in FIG. 11 when the composite machine 1 is packed as shown in FIG. 10. Preferably, the at least one specific nozzle 50T is constituted by the four nozzles 50 located at a lower portion of each of the four rows corresponding to the respective inks of the four different colors. After the above-mentioned initial ink sucking action (S2) and all-nozzle-ink-ejecting action (S3), the partial-nozzle-ink-ejecting action (S4) is executed for the specific nozzles 50T. Where the composite machine 1 is kept, during the transportation or storage period before its initial working, in the posture that the ink ejection openings 50*a* of the nozzles 50 spread in the vertical direction, namely, each of the four rows of the nozzles 50 extends in the vertical direction, the inks which leak from the ink ejection openings 50*a* remain at a lower portion of the cap 49 as shown in FIG. 11 and mix with each other. The thus mixed ink I enter the specific nozzles 50T in the vicinity of the lower portion of the recording head 40 kept at the posture shown in FIG. 11. According to the arrangement of the second embodiment, the partial-ink-ejecting action is executed for specific nozzles 50T as described above, so that the mixed ink I entered the specific nozzles 50T can be completely removed. Because the partial-nozzle-ink-ejecting action is executed only for the specific nozzles 50T and the inks are not discharged from other nozzles 50 except the specific nozzles 50T, the entire ink consumption amount in the head cleaning operation can be reduced.

In the second embodiment, the composite machine 1 is accommodated in the box 107 with its front and rear extending in the vertical direction. The arrangement according to the second embodiment is true of a case in which the composite machine 1 is accommodated in the box 107 with its two sides extending in the vertical direction.

Third Embodiment

Next, there will be explained a third embodiment of the invention. Because the third embodiment differs from the illustrated first or second embodiment only in the at least one specific nozzle 50T in the partial-nozzle-ink-ejecting action (S4), and other processing such as the initial ink sucking action and the all-nozzle-ink-ejecting action and the structure of the composite machine 1 are the same as those in the first or second embodiment, the following explanation is limited to that different portion.

In this third embodiment, the at least one specific nozzle 50T is constituted by the nozzles 50 for ejecting the magenta ink (M) and the yellow ink (Y) except the nozzles 50 for ejecting the cyan ink (C) which is the darkest among the three color inks (C, M and Y), among the nozzles 50 located in the vicinity of the downstream portion of each manifold chamber 53 remote from the corresponding ink inlet 52*a* as shown in FIG. 6 described in the illustrated first embodiment, or the nozzles 50 located at the lower portion of the recording head 40 which assumes the posture shown in FIG. 11 described in the illustrated second embodiment.

As noted above, the cap 49 has the first cap portion 49*a* for fluid-tightly covering the black-ink ejection openings 50*a* from which is ejected the black ink and the second cap portion 49*b* for fluid-tightly covering the color-ink ejection openings 50*a* from which are ejected the color inks, i.e., the cyan ink (C), the magenta ink (M) and the yellow ink (Y). Accordingly, the black ink and the color inks (C, M and Y) are prevented from mixing with each other in the cap 49 when the cap 49 fluid-tightly covers the nozzle surface of the recording head 40. It is noted that, among the color inks ejected from the color-ink ejection openings 50*a* arranged to be fluid-tightly covered with the second cap portion 49*b*, one of the color inks which is the darkest relative to the other color inks is less likely to be influenced by the contamination with the mixed ink in the recorded image.

Therefore, the at least one specific nozzle 50T is constituted without including the nozzles 50 for ejecting the cyan ink (C) which is the darkest relative to the other color inks, whereby the partial-ink-ejecting action (S4) is not executed for the nozzles which eject the cyan ink (C). This arrangement is effective to reduce, in the initial ink ejecting action, the consumption amount of the dark color ink which is less likely to be influenced by the mixed ink while executing the partial-ink-ejecting action only for the nozzles for ejecting the other color inks which are likely to be influenced by the mixed ink. In this third embodiment, among the three color inks, C, M and Y ejected from the ink-ejection openings 50*a* of the nozzles 50 which are arranged to be fluid-tightly covered by the second cap portion 49*b* of the cap 49, the darkest color ink is determined to be the cyan ink (C). It is noted, however, that the darkest color ink is determined relatively depending upon the shade or tone, among the color inks ejected from the ink-ejection openings 50*a* that are arranged to be fluid-tightly covered by the second cap portion 49*b* of the cap 49. Therefore, the darkest color ink is not limited to the cyan ink (C).

Fourth Embodiment

Next, there will be explained a fourth embodiment of the invention. Like the illustrated third embodiment, the fourth embodiment differs from the illustrated first or second embodiment only in the at least one specific nozzle 50T in the partial-nozzle-ink-ejecting action (S4) and other processing such as the initial ink sucking action and the all-nozzle-ink-ejecting action and the structure of the composite machine 1 are the same as those in the first or second embodiment. Therefore, the following explanation is limited to that different portion.

In this fourth embodiment, the at least one specific nozzle 50T is constituted by the nozzles 50 for ejecting the yellow ink (Y) which is the lightest among the three color inks (C, M and Y), among the nozzles 50 located in the vicinity of the downstream portion of each manifold chamber 53 remote from the corresponding ink inlet 52*a* as shown in FIG. 6 described in the illustrated first embodiment, or the nozzles 50 located at the lower portion of the recording head 40 which assumes the posture shown in FIG. 11 described in the illustrated second embodiment.

As noted above, the cap 49 has the first cap portion 49*a* for fluid-tightly covering the black-ink ejection openings 50*a* from which is ejected the black ink and the second cap portion 49*b* for fluid-tightly covering the color-ink ejection openings 50*a* from which are ejected the color inks, i.e., the cyan ink (C), the magenta ink (M) and the yellow ink (Y). Accordingly, the black ink and the color inks (C, M and Y) are prevented from mixing with each other in the cap 49 when the cap 49 fluid-tightly covers the nozzle surface of the recording head 40. It is noted that, among the color inks ejected from the color-ink ejection openings 50*a* which are arranged to be fluid-tightly covered with the second cap portion 49*b*, one of the color inks which is the lightest relative to the other color inks tends to be influenced by the contamination with the mixed ink in the recorded image.

Therefore, the nozzles 50 for ejecting the yellow ink (Y) which is the lightest relative to the other color inks are determined as the at least one specific nozzle 50T, whereby the partial-ink-ejecting action (S4) is executed only for the nozzles which eject the yellow ink (Y). This arrangement is effective to reduce, in the initial ink ejecting action, the consumption amount of the other color inks which are less likely to be influenced by the mixed ink. In this fourth embodiment, among the three color inks, C, M and Y ejected from the ink-ejection openings 50*a* of the nozzles 50 which are arranged to be fluid-tightly covered by the second cap portion 49*b* of the cap 49, the lightest color ink is determined to be the yellow ink (Y). It is noted, however, that the lightest color ink is determined relatively depending upon the shade or tone, among the color inks ejected from the ink-ejection openings 50*a* that are arranged to be fluid-tightly covered by the second cap portion 49*b* of the cap 49. Therefore, the lightest color ink is not limited to the yellow ink (Y).

It is to be understood that the present invention may be embodied with various changes and modifications, which may occur to those skilled in the art, without departing from the spirit and scope of the invention defined in the attached claims.

What is claimed is:

1. An ink-jet recording apparatus, comprising:

a recording head including a plurality of ink chambers provided for each of a plurality of inks of mutually different colors and a plurality of nozzles each of which communicates with one of the ink chambers, the plurality of nozzles are arranged in rows, each of the plurality of ink chambers extending in a longitudinal direction of extension of the rows of the plurality of nozzles, the recording head performing recording by ejecting, from each of the nozzles, a corresponding one of the inks which corresponds to said each of the nozzles;

an ink suction device including a cap arranged to fluid-tightly cover a nozzle surface of the recording head in which the nozzles are formed, the ink suction device sucking the inks from the nozzles utilizing the cap;

a control device for controlling the ink-jet recording apparatus, the control device including an initial-cleaning-operation executing portion which is configured to execute an initial cleaning operation including:

controlling the ink suction device to execute an initial ink sucking action wherein the inks are sucked from the nozzles; and controlling the recording head to execute (a) an all-nozzle-ink-ejecting action for all of the nozzles to eject the corresponding one of the inks from all of the nozzles at a plurality of shots and (b) a partial-nozzle-ink-ejecting action in which the corresponding one of the inks is ejected from at least one first specific nozzle among the plurality of nozzles at a plurality of shots while no ink is ejected from any other nozzle among the plurality of nozzles;

a plurality of buffer tanks which receive and store the respective inks of mutually different colors from respective ink tanks that correspond to the respective inks via respective passages that correspond to the respective inks, the plurality of buffer tanks supply the respective inks to the respective ink chambers; and a plurality of inlets through which the respective inks are supplied from the respective buffer tanks to the respective ink chambers, each of the plurality of inlets is located at a first longitudinal end portion of a corresponding one of the ink chambers, wherein the at least one first specific nozzle is disposed at a second longitudinal end portion of the corresponding one of the ink chambers, the second longitudinal end portion of the corresponding one of the ink chambers is remote from the inlet of the corresponding one of the ink chambers, and at least one second specific nozzle is disposed at the first longitudinal end portion of the corresponding one of the ink chambers, and wherein each of the ink chambers has a cross sectional area which gradually decreases in the longitudinal direction away from a corresponding one of the ink inlets provided for said each of the ink chambers.

2. The ink-jet recording apparatus according to claim 1, wherein each of the ink chambers is defined by a first wall surface in which are formed the nozzles provided for said each of the ink chambers and a second wall surface confronting the first wall surface, and a distance between the first and the second wall surfaces gradually decreases in a direction away from a corresponding one of the ink inlets provided for said each of the ink chambers.

3. The ink-jet recording apparatus according to claim 1, wherein the initial-cleaning-operation executing portion executes the initial cleaning operation in which an amount of the corresponding one of the inks ejected from each of the at least one specific nozzle in the partial-nozzle-ink-ejecting action is larger than an amount of the corresponding one of the inks ejected from each of the nozzles in the all-nozzle-ink-ejecting action.

4. The ink-jet recording apparatus according to claim 1, wherein the recording head ejects the inks including a black ink from the nozzles, wherein the cap includes a first cap portion arranged to fluid-tightly cover a part of the nozzle surface of the recording head in which are formed black-ink nozzles for ejecting the black ink, and wherein the ink suction device is arranged to execute suction from the black-ink nozzles and suction from the rest of the nozzles other than the black-ink nozzles for ejecting at least one ink other than the black ink, independently of each other.

5. The ink-jet recording apparatus according to claim 4, wherein the cap includes a second cap portion arranged to fluid-tightly cover a part of the nozzle surface of the recording head in which are formed the rest of the nozzles other than the black-ink nozzles for ejecting the at least one ink other than the black ink, and wherein the ink suction device is arranged to execute suction from the rest of the nozzles other than the black-ink nozzles at one time.

6. The ink-jet recording apparatus according to claim 1, wherein the control device includes an initial-working judging portion which judges upon turning on a power of the ink-jet recording apparatus whether or not the ink-jet recording apparatus is about to be subjected to the initial working.

7. The ink-jet recording apparatus according to claim 6 wherein the initial-cleaning-operation executing portion executes the initial cleaning operation on the condition that the judging portion judges that the ink-jet recording apparatus is about to be subjected to the initial working.

8. The ink-jet recording apparatus according to claim 6, wherein the initial-cleaning-operation executing portion is arranged to execute the initial cleaning operation on the basis of a command given by an operator for permitting initiation of the initial cleaning operation.

9. The ink-jet recording apparatus according to claim 8, further comprising a display device on which a status of the ink-jet recording apparatus can be indicated, wherein the control device includes an initial-cleaning-operation encouraging portion which executes an operation of indicating, on the display device, an indication which encourages execution of the initial cleaning operation when the judging portion judges that the ink-jet recording apparatus is about to be subjected to the initial working.

10. The ink-jet recording apparatus according to claim 6, wherein the control device includes a wait-state realizing portion which places the ink-jet recording apparatus in a wait state for performing recording when the judging portion judges that the ink-jet recording apparatus is not about to be subjected to the initial working.

11. The ink-jet recording apparatus according to claim 1, wherein the control device includes an additional-cleaning-operation executing portion which executes, after execution of the initial cleaning operation, an additional cleaning operation including at least one of:

controlling the ink suction device to execute an initial ink sucking action wherein the inks are sucked from the nozzles;

controlling the recording head to execute an all-nozzle-ink-ejecting action for all of the nozzles to eject the corresponding one of the inks from each of all of the nozzles at a plurality of shots; and controlling the recording head to execute a partial-nozzle-ink-ejecting action for at least one specific nozzle among the plurality of nozzles to eject the corresponding one of the inks from each of the at least one specific nozzle at a plurality of shots.

12. The ink-jet recording apparatus according to claim 11, wherein the additional-cleaning-operation executing portion is arranged to execute the additional cleaning operation on the basis of a command given by an operator for permitting initiation of the additional cleaning operation.

13. The ink-jet recording apparatus according to claim 11, wherein the control device includes a test-recording executing portion which controls the recording head to execute test recording.

14. The ink-jet recording apparatus according to claim 13, wherein the additional-cleaning-operation executing portion is arranged to execute the additional cleaning operation on the basis of information that a result of the test recording is poor.

15. The ink-jet recording apparatus according to claim 14, further comprising a display device on which a status of the ink-jet recording apparatus can be indicated, wherein the control device includes a test-recording encouraging portion which executes an operation of indicating, on the display device, an indication which encourages execution of the test recording.

16. The ink-jet recording apparatus according to claim 13, wherein the test-recording executing portion is arranged to execute the test recording on the basis of a command given by an operator for permitting initiation of the test recording.

17. The ink-jet recording apparatus according to claim 13, wherein the control device includes a wait-state realizing portion which places the ink-jet recording apparatus in a wait state for performing recording, on the basis of information that a result of the test recording is good.

18. The ink-jet recording apparatus according to claim 1, wherein the second longitudinal end portions of the at least one of the ink chambers protrudes beyond an end of the rows of the plurality of nozzles.

19. The ink-recording apparatus according to claim 1, wherein the initial cleaning operation ends with completion of partial-nozzle-ink-ejecting action.

20. A method of cleaning a recording head of an ink-jet recording apparatus upon initial working, the recording head including:

a plurality of ink chambers provided for each of a plurality of inks of mutually different colors;

a plurality of nozzles each of which communicates with one of the ink chambers and the plurality of nozzles are arranged in rows, each of the plurality of ink chambers extending in a longitudinal direction of extension of the rows of the plurality of nozzles;

a plurality of buffer tanks which receive and store the respective inks of mutually different colors from respective ink tanks that correspond to the respective inks via respective passages that correspond to the respective inks, the plurality of buffer tanks supply the respective inks to the respective ink chambers; and a plurality of inlets through which the respective inks are supplied from the respective buffer tanks to the respective ink chambers, each of the plurality of inlets is located at a first longitudinal end portion of a corresponding one of the ink chambers, each of the ink chambers has a cross sectional area which gradually decreases in the longitudinal direction away from a corresponding one of the ink inlets provided for said each of the ink chambers;

the recording head performing recording by ejecting, from each of the nozzles, a corresponding one of the inks which corresponds to said each of the nozzles, the method comprising:

sucking the inks from the nozzles;

an all-nozzle-ink step of ejecting the corresponding one of the inks from all of the nozzles at a plurality of shots; and a partial-nozzle-ink ejecting step of ejecting, after the all-nozzle ink ejecting step, the corresponding one of the inks from at least one first specific nozzle among the plurality of nozzles at a plurality of shots without ejecting the corresponding one of the inks from any other nozzle among the plurality of nozzles, wherein the at least one first specific nozzle is disposed at a second longitudinal end portion of the corresponding one of the ink chambers, the second longitudinal end portion of the corresponding one of the ink chambers is remote from the inlet of the corresponding one of the ink chambers, and at least one second specific nozzle is disposed at the first longitudinal end portion of the corresponding one of the ink chambers.

21. The method according to claim 20, wherein the second longitudinal end portions of the at least one of the ink chambers protrudes beyond an end of the rows of the plurality of nozzles.

* * * * *